US012798845B2

(12) United States Patent
Farris

(10) Patent No.: US 12,798,845 B2
(45) Date of Patent: Nov. 17, 2026

(54) DEVICE FOR CLOSING A CONTAINER TO MAKE THE CONTAINER REUSABLE

(71) Applicant: Norma Farris, Lehi, UT (US)

(72) Inventor: Norma Farris, Lehi, UT (US)

( * ) Notice: Subject to any disclaimer, the term of this patent is extended or adjusted under 35 U.S.C. 154(b) by 441 days.

(21) Appl. No.: 18/219,573

(22) Filed: Jul. 7, 2023

(65) Prior Publication Data

US 2024/0017894 A1 Jan. 18, 2024

Related U.S. Application Data

(60) Provisional application No. 63/388,933, filed on Jul. 13, 2022.

(51) Int. Cl.
*B65D 55/02* (2006.01)

(52) U.S. Cl.
CPC ..... *B65D 55/02* (2013.01)

(58) Field of Classification Search
CPC .. B65D 55/02; B65D 2251/1016; B65D 5/02; B65D 5/0236; B65D 5/6611; B65D 5/001; B65D 2313/02
USPC ..... 229/125.39, 125.37, 155; 220/315, 323, 220/234, 826, 833, 834, 646, 650, 62
See application file for complete search history.

(56) References Cited

U.S. PATENT DOCUMENTS

| | | | | |
|---|---|---|---|---|
| 933,454 | A * | 9/1909 | Hudson | B65D 5/643 229/126 |
| 3,221,977 | A * | 12/1965 | Pollert | B65D 5/4604 229/125.41 |
| 6,230,965 | B1 * | 5/2001 | Dismukes | B65D 5/643 24/561 |
| 7,284,688 | B1 * | 10/2007 | Barsness | B65D 5/643 229/125.39 |
| 7,854,372 | B1 * | 12/2010 | Bartone, Sr. | B65D 5/4283 24/546 |
| 9,321,566 | B2 * | 4/2016 | Weber | B65D 5/643 |
| 11,173,618 | B2 * | 11/2021 | Koizumi | B26B 3/08 |
| 11,530,072 | B1 * | 12/2022 | Wilcox | B65D 5/643 |
| 2011/0192891 | A1 * | 8/2011 | Farris | B65D 5/6647 229/155 |

* cited by examiner

*Primary Examiner* — Christopher R Demeree
(74) *Attorney, Agent, or Firm* — Kunzler Needham & Hilton; Bruce R. Needham

(57) ABSTRACT

Disclosed herein is an apparatus for selectively maintaining a container in a closed position. The apparatus includes a connection mechanism couplable to a container. The container includes a bottom, a top, and sides. The top includes a first flap and a second flap. The first flap includes a first hinge end and a first edge opposite the first hinge end. The second flap includes a second hinge end and a second edge opposite the second hinge end. The first and second hinge ends are each connected to a side of the container. The connection mechanism extends substantially along a first edge of the first flap. The first edge is adjacent to a second edge of the second flap when the first and second flaps are in a closed position. In some embodiments, the apparatus includes the tab of the connection mechanism being fixedly coupled to the first flap.

20 Claims, 15 Drawing Sheets

DEVICE FOR CLOSING A CONTAINER TO MAKE THE CONTAINER REUSABLE

CROSS-REFERENCES TO RELATED APPLICATIONS

This application claims the benefit of and priority to U.S. Provisional Patent Application No. 63/388,933 entitled "DEVICE FOR CLOSING A CONTAINER TO MAKE THE CONTAINER REUSABLE" and filed on Jul. 13, 2022, for Norma Farris, which is incorporated herein by reference.

FIELD

The subject matter disclosed herein relates to container closing mechanisms, and more particularly to a device that selectively maintains a container such as a cardboard box in the closed position and provides structural strength to enable effective stacking of containers.

BACKGROUND

Containers such as cardboard boxes are commonly used by business and by individuals to store and ship items. Most often, bottom flaps of cardboard boxes are sealed with tape or glue, forming a container which is then filled with items. The top flaps of the container are then taped shut so the box can be transported or stored. Unloading the box contents requires the removal of the tape, which is often done using a knife or some other tool, often cuts or rips the box, damaging it permanently. The damaged boxes are then thrown away or recycled and new ones must be purchased.

When a box is used for storage, often times only a few items contained in the box are needed. An individual must remove any tape or glue, access the needed contents and then reseal the box with tape. This process is repeated as often as access to the contents is needed. Repeated unsealing, opening, and resealing of the box increases wear on the box and shortens its lifespan as well as adding the cost of the tape each time the box needs to be resealed. Additionally, tape and glue do not add structural strength to the container.

BRIEF SUMMARY

Disclosed herein is an apparatus for selectively maintaining a container in a closed position. The apparatus includes a connection mechanism couplable to a container. The container includes a bottom, a top, and sides. The top includes a first flap and a second flap. The first flap includes a first hinge end and a first edge opposite the first hinge end. The second flap includes a second hinge end and a second edge opposite the second hinge end. The first and second hinge ends are each connected to a side of the container. The connection mechanism extends substantially along a first edge of the first flap. The first edge is adjacent to a second edge of the second flap when the first and second flaps are in a closed position. The connection mechanism includes a tab couplable along the first edge of the first flap, and a channel opposite the tab configured to enclose a portion of the second flap along a substantial portion of the second edge. When the first and second flaps are in an open position the tab remains coupled to the first flap. When the first and second flaps are in the closed position the channel maintains the second edge in the channel while the tab remains coupled to the first flap.

Another apparatus for selectively maintaining a container in a closed position including a connection mechanism couplable to a container. The container includes a bottom, a top, and sides, the top includes a first flap and a second flap. The first flap includes a first hinge end and a first edge opposite the first hinge end. The second flap includes a second hinge end and a second edge opposite the second hinge end. The first and second hinge ends are each connected to a side of the container. The connection mechanism extends substantially along a first edge of the first flap. The first edge is adjacent to a second edge of the second flap when the first and second flaps are in a closed position. The connection mechanism includes a tab couplable along the first edge of the first flap, a channel opposite the tab configured to enclose a portion of the second flap along a substantial portion of the second edge, and one or more straps extending from sides of the connection mechanism to at least one of opposite sides of the container. When the first and second flaps are in an open position the tab remains coupled to the first flap. When the first and second flaps are in the closed position the channel maintains the second edge in the channel while the tab remains coupled to the first flap. The one or more straps are couplable to one or both of the opposite sides of the container.

Another apparatus for selectively maintaining a container in a closed position includes a connection mechanism couplable to a container top. The container top includes a first flap and a second flap. The first flap includes a first hinge end and a first edge opposite the first hinge end. The second flap includes a second hinge end and a second edge opposite the second hinge end. The first and second hinge ends are each connected to a side of the container. The connection mechanism extends substantially along a first edge of the first flap. The first edge is adjacent to a second edge of the second flap when the first and second flaps are in a closed position. The connection mechanism includes a tab couplable along the first edge of the first flap, a channel opposite the tab configured to enclose a portion of the second flap along a substantial portion of the second edge, and straps extending from the connection mechanism to opposite sides of the container. When the first and second flaps are in an open position the tab remains coupled to the first flap. When the first and second flaps are in the closed position the channel maintains the second edge in the channel while the tab remains coupled to the first flap. The straps are couplable to the opposite sides of the container. The apparatus includes one or more of a strap and two or more hook and loop fasteners. The strap is detachably couplable to opposite sides of the container such that the strap maintains a container bottom of the container in a closed position. Each hook and loop fastener includes a first portion couplable to a second portion. The first portion includes tapered edges on each end and the second portion has ends configured to connect with corresponding tapered edges of the first portion that are wider than the tapered edges of the first portion. The two or more hook and loop fasteners are positioned between third and fourth flaps of the container bottom and corresponding flaps interior to the container on the container bottom and maintain the third and fourth flaps in the closed position.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1A:
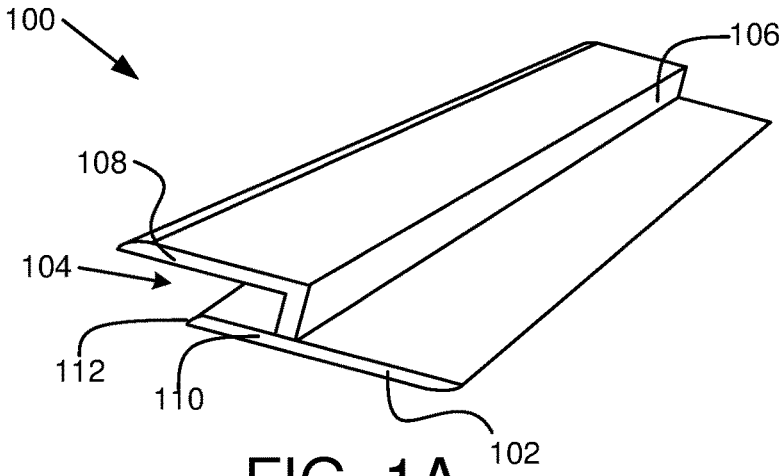
FIG. 1A is a schematic perspective view of a connection mechanism for selectively maintaining a container in a closed position, according to various embodiments.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims or may be learned by the practice of embodiments as set forth hereinafter.

Disclosed herein is an apparatus for selectively maintaining a container in a closed position. The apparatus includes a connection mechanism couplable to a container. The container includes a bottom, a top, and sides. The top includes a first flap and a second flap. The first flap includes a first hinge end and a first edge opposite the first hinge end. The second flap includes a second hinge end and a second edge opposite the second hinge end. The first and second hinge ends are each connected to a side of the container. The connection mechanism extends substantially along a first edge of the first flap. The first edge is adjacent to a second edge of the second flap when the first and second flaps are in a closed position. The connection mechanism includes a tab couplable along the first edge of the first flap, and a channel opposite the tab configured to enclose a portion of the second flap along a substantial portion of the second edge. When the first and second flaps are in an open position the tab remains coupled to the first flap. When the first and second flaps are in the closed position the channel maintains the second edge in the channel while the tab remains coupled to the first flap.

In some embodiments, the apparatus includes the tab of the connection mechanism being fixedly coupled to the first flap. In other embodiments, the tab is fixedly coupled to the first flap by an adhesive strip, a mechanical fastener, a hook and loop mechanism, and/or an adhesive. The mechanical fastener, in various embodiments, is a staple, clamp, and/or brad fastener.

In some embodiments, the apparatus includes a channel where the channel includes an upper wall and a lower wall forming a channel there between. The upper wall extends away from the tab a longer distance than the lower wall. In other embodiments, the channel includes an upper wall and a lower wall forming a channel therebetween. The lower wall includes a tapered edge such that the channel is wider at an opening of the channel than interior portions of the channel beyond the tapered edge. In other embodiments, the channel is a first channel and the tab is a first tab and the apparatus further includes a second tab. The first tab and the second tab form a second channel therebetween. The second channel is configured to couple to the first flap by a friction fit. In some embodiments, the connection mechanism includes a rigid material.

In some embodiments, the channel maintains the second flap within the channel when the first flap and the second flap are in the closed position. A depth of the channel is configured to allow the second flap to enter the channel without creasing the second flap. In some embodiments, the apparatus includes a strap. The strap is detachably coupled to opposite sides of the container so that the strap maintains one of the bottom in a closed position or the first and second flaps in the closed position. The bottom includes a third flap and a fourth flap. The third flap includes a third hinge end and an third edge opposite the third hinge end. The fourth flap includes a fourth hinge end and a fourth edge opposite the fourth hinge end. The third and fourth hinge ends are each connected to a side of the container.

In some embodiments, the apparatus includes a strap extending from one or both sides of the connection mechanism and are detachably couplable to one or both sides of the container. In other embodiments, the strap is configured to be detachably couplable to the connection mechanism and the opposite sides of the container such that the strap maintains the top of the container in the closed position. In other embodiments, the strap is a first strap and extends from a first side of the connection mechanism and includes a second strap extending from a second side of the connection mechanism. Each of the first and second straps is configured to be detachably couplable to the connection mechanism and/or one of opposite sides of the container.

In some embodiments, the apparatus includes two or more hook and loop fasteners. Each hook and loop fastener includes a first portion couplable to a second portion. The first portion includes tapered edges on each end and the second portion has ends configured to connect with corresponding tapered edges of the first portion that are wider than the tapered edges of the first portion. The two or more hook and loop fasteners are positioned between the flaps of the top of the container and/or between flaps of the bottom of the container to hold the flaps of the top and/or the flaps of the bottom together.

Another apparatus for selectively maintaining a container in a closed position including a connection mechanism couplable to a container. The container includes a bottom, a top, and sides, the top includes a first flap and a second flap. The first flap includes a first hinge end and a first edge opposite the first hinge end. The second flap includes a second hinge end and a second edge opposite the second hinge end. The first and second hinge ends are each connected to a side of the container. The connection mechanism extends substantially along a first edge of the first flap. The first edge is adjacent to a second edge of the second flap when the first and second flaps are in a closed position. The connection mechanism includes a tab couplable along the first edge of the first flap, a channel opposite the tab configured to enclose a portion of the second flap along a substantial portion of the second edge, and one or more straps extending from sides of the connection mechanism to at least one of opposite sides of the container. When the first and second flaps are in an open position the tab remains coupled to the first flap. When the first and second flaps are in the closed position the channel maintains the second edge in the channel while the tab remains coupled to the first flap. The one or more straps are couplable to one or both of the opposite sides of the container.

In some embodiments, the one or more straps are fixed to the connection mechanism. In other embodiments, the one or more straps are removably coupled to the connection mechanism. In other embodiments, the one or more straps include a single strap coupled to the connection mechanism. A length of the single strap exceeds a length of the connection mechanism and the single strap is configured to be couplable to both of the opposite sides of the container. In other embodiments, the one or more straps include two straps. Each of the two straps is couplable to the connection mechanism and to one of the opposite sides of the container. In some embodiments the one or more straps include a pliable material.

In some embodiments the apparatus includes two or more hook and loop fasteners. Each hook and loop fastener includes a first portion couplable to a second portion. The first portion includes tapered edges on each end and the second portion has ends configured to connect with corresponding tapered edges of the first portion that are wider than the tapered edges of the first portion. The two or more hook and loop fasteners are positioned between flaps of the top of the container and/or between flaps of the bottom of the container to hold the flaps of the top and/or the flaps of the bottom together.

Another apparatus for selectively maintaining a container in a closed position includes a connection mechanism couplable to a container top. The container top includes a first flap and a second flap. The first flap includes a first hinge end and a first edge opposite the first hinge end. The second flap includes a second hinge end and a second edge opposite the second hinge end. The first and second hinge ends are each connected to a side of the container. The connection mechanism extends substantially along a first edge of the first flap. The first edge is adjacent to a second edge of the second flap when the first and second flaps are in a closed position. The connection mechanism includes a tab couplable along the first edge of the first flap, a channel opposite the tab configured to enclose a portion of the second flap along a substantial portion of the second edge, and straps extending from the connection mechanism to opposite sides of the container. When the first and second flaps are in an open position the tab remains coupled to the first flap. When the first and second flaps are in the closed position the channel maintains the second edge in the channel while the tab remains coupled to the first flap. The straps are couplable to the opposite sides of the container. The apparatus includes one or more of a strap and two or more hook and loop fasteners. The strap is detachably couplable to opposite sides of the container such that the strap maintains a container bottom of the container in a closed position. Each hook and loop fastener includes a first portion couplable to a second portion. The first portion includes tapered edges on each end and the second portion has ends configured to connect with corresponding tapered edges of the first portion that are wider than the tapered edges of the first portion. The two or more hook and loop fasteners are positioned between third and fourth flaps of the container bottom and corresponding flaps interior to the container on the container bottom and maintain the third and fourth flaps in the closed position.

Figure 1B:
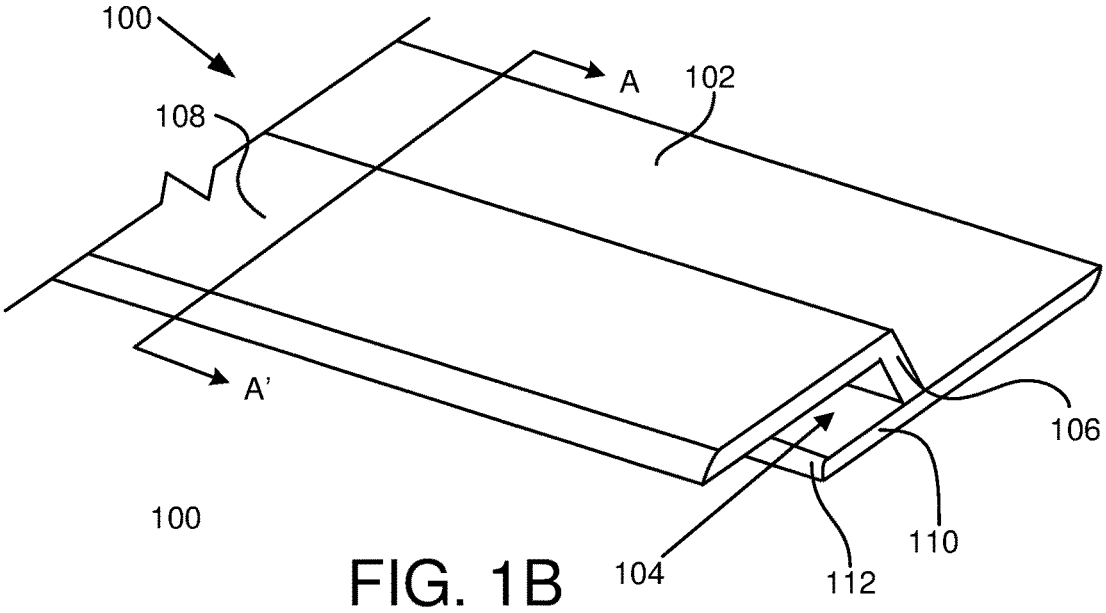
FIG. 1B is another schematic perspective view of the connection mechanism of FIG. 1, according to various embodiments.
Figure 1C:
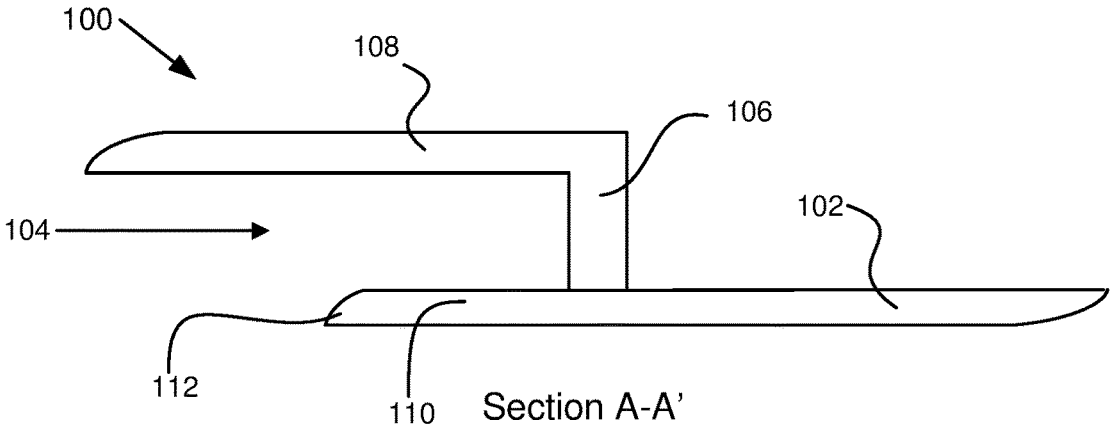
FIG. 1C is a cross section view of the connection mechanism of FIG. 1A, according to various embodiments.

FIG. 1A is a schematic perspective view of a connection mechanism 100 for selectively maintaining a container in a closed position, according to various embodiments. FIG. 1B is another schematic perspective view of the connection mechanism 100 of FIG. 1, according to various embodiments. FIG. 1C is a cross section view of the connection mechanism 100 of FIG. 1A, according to various embodiments. The connection mechanism 100 is intended to be used to close a container, such as the container 200 depicted in FIGS. 2A and 2B, which is described below.

The connection mechanism 100, includes a tab 102 and a channel 104. The tab 102 and the channel 104 being opposite each other. The channel 104 includes a lower wall 110 and an upper wall 108 with the channel 104 there between. The channel 104 has an open end and a closed end. The closed end is closed off by a channel backbone 106. The tab 102 protrudes from the opposite side of the channel backbone 106. The channel backbone 106 provides structure and rigidity to the connection mechanism 100. The tab 102 is configured to interface with the bottom face of a top container flap 201 of the container 200. The tab 102 is fixedly coupled to the first flap 201. When the first flap 201 is coupled, the tab 102 is flush to a portion of the bottom of the first flap 201 near a first edge 203 of the first flap 201. In some embodiments, the lower wall 110 includes a tapered edge 112. In some embodiments, all edges of the connection mechanism 100 are tapered. Having a tapered edge prevents the connection mechanism 100 from catching or snagging on surrounding objects and allows the surrounding objects to slide past the connection mechanism 100. In some embodiments the angle between the channel backbone 106 and the upper channel wall 108 and the lower channel wall 110 may be 90 degrees. In other embodiments the angle may be more than or less than 90 degrees.

The connection mechanism 100 of the present application has been developed in response to the present state of the art, and in response to shortcomings of conventional tools and apparatuses for maintaining containers closed. The connection mechanism 100, claimed in this application, selectively seals containers that are opened and closed using flaps, such as cardboard boxes. The connection mechanism 100, in some embodiments, is a long, rigid piece of material that has a tab 102 that runs the length of the connection mechanism 100 on one side and a channel 104 that runs the length of the connection mechanism 100 on the opposite side. The tab 102 is secured to a flap of a container 200, such as a cardboard box, and the channel 104 is designed to grip an opposing flap of the container 200 effectively linking the opposing flaps together and holding the container 200 shut. The connection formed by the connection mechanism 100, in some embodiments, is sufficiently strong to hold the container 200 shut while being moved, but not so strong as to prevent the container 200 from being opened by pulling up on the connection mechanism 100 and flaps.

The connection mechanism 100 is an alternative to glue, tape, staples and other traditional methods of sealing a container 200 shut. Containers 200 in the form of cardboard boxes are commonly used for moving and storage. When a cardboard box is sealed using glue, tape, or staples, opening the box often damages it significantly, rendering the cardboard box useless. Removing the tape can rip the cardboard box and leave the cardboard box unusable. When tab 102 is attached to a cardboard box, or other container, the connection mechanism 100 can hold the cardboard box closed using a friction fit. The connection mechanism 100 has a specially designed channel that is made to enclose a portion of a flap of a container 200. Once the connection mechanism 100 is fixed to one cardboard box flap and grips an opposing cardboard box flap, the cardboard box is shut, eliminating the need for tape and glue. The cardboard box can be repeatedly opened and closed without damaging the cardboard box. The connection mechanism 100 prevents damage to the cardboard box and also allows for easy storage when the cardboard box is not in use. The connection mechanism 100 can easily be released from one of the cardboard box flaps and the box can be folded and stored. This allows individuals to repeatedly reuse cardboard boxes and save a significant amount of money.

The connection mechanism 100 is made of a rigid material, such as plastic, metal, or a composite, and adds strength to the container. When a container is closed using the connection mechanism 100, rather than tape or glue, more weight can be placed on the top of the box than when tape or glue is used. The connection mechanism will be able to support more weight if it runs the entire length of the top of the box rather than just a portion of the length of the top of the box.

Figure 2B:
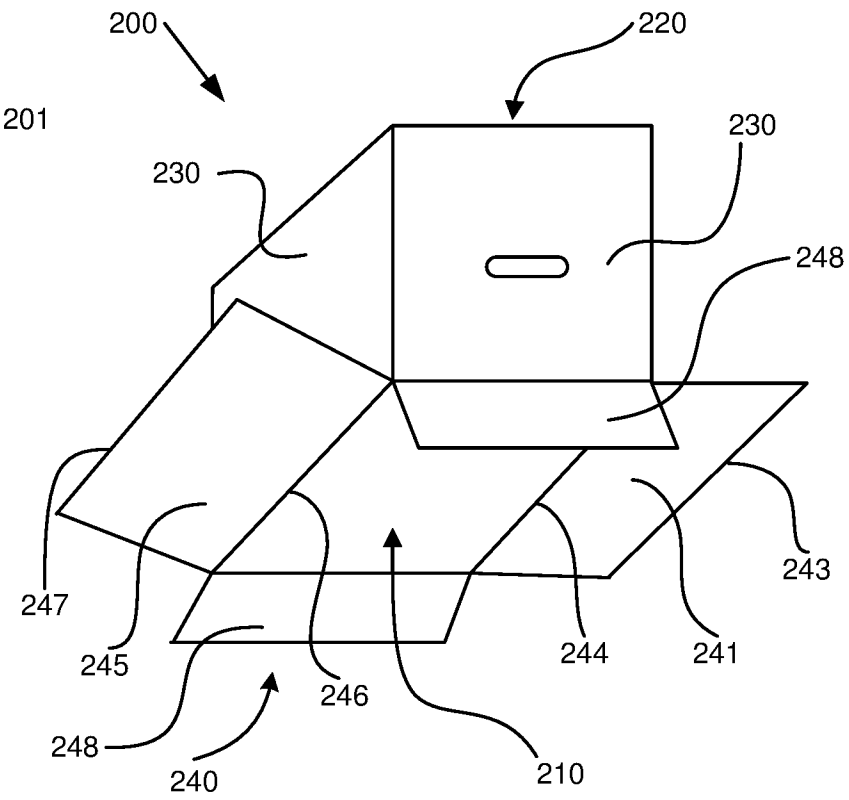
FIG. 2B is a bottom schematic perspective view of the container of FIG. 2A.
Figure 2A:
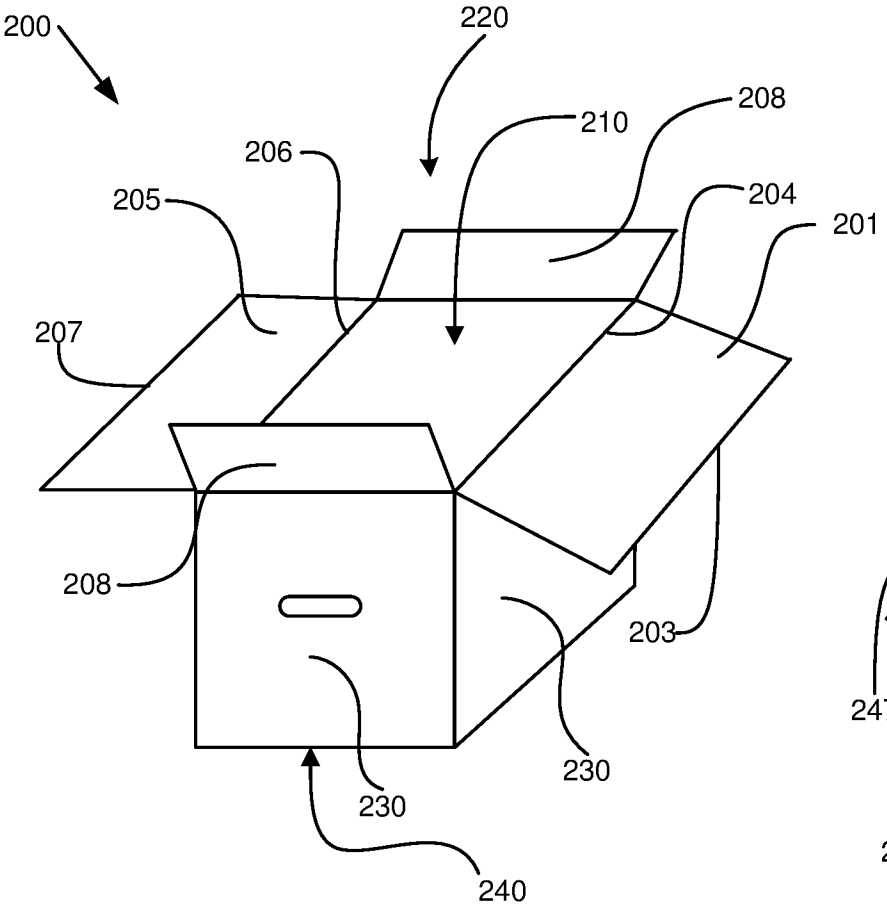
FIG. 2A is a top schematic perspective view of a container on which the connection mechanism may be fixed, according to various embodiments.

FIG. 2A is a top schematic perspective view of a container 200 on which the connection mechanism 100 may be fixed, according to some embodiments. FIG. 2B is a bottom schematic perspective view of the container 200 of FIG. 2A. The container 200 includes a bottom 240, a top 220, and sides 230 that enclose an interior space 210. The top 220 includes a first flap 201 and a second flap 205. The top 220 may also include side flaps 208. The first flap 201 has a first hinge end 204 and an first edge 203 opposite the first hinge end 204. The second flap 205 includes a second hinge end 206 and a second edge 207 opposite the second hinge end 206. The first and second hinge ends 204, 206 are each connected to a side 230 of the container 200. The first edge 203 is adjacent to the second edge 207 of the second flap 205 when the first flap 201 and second flap 205 are in a closed position.

In some embodiments, the bottom 240 includes two or more flaps. One of the two or more flaps is a third flap 241 and another one of the two or more flaps is a fourth flap 245. The bottom 240 may also include side flaps 248. The third flap 241 has a third hinge end 244 and a third edge 243 opposite the third hinge end 244. The fourth flap 445 has a fourth hinge end 246 and a fourth edge 247 opposite the fourth hinge end 246. The third and fourth hinge ends 244, 246 are each connected to a side 230 of the container 200. In some embodiments, the third edge 243 of the third flap 241 is adjacent to the fourth edge 247 of the fourth flap 245 when the third flap 241 and the fourth flap 245 are in a closed position. In some embodiments, the connection mechanism 100 extends substantially along the first edge 203 of the first flap 201. As used herein, the connection mechanism 100 extends substantially along the first edge 203 of the first flap 201 includes the connection mechanism 100 extending most of the way along the first edge 203 but not all the way along the first edge 203 within a range of at least 90 percent of the length of the first edge 203. In some examples, the connection mechanism 100 extends substantially along the first edge 203 of the first flap 201 includes the connection mechanism 100 extending a small amount past the first edge 203, such as up to 2 percent past an end of the first edge 203. One of skill in the art will recognize appropriate variations of length of the connection mechanism 100 with respect to a length of the first edge 203.

FIG. 2A is a depiction of an embodiment of container 200 with the top 220 open and FIG. 2B is a depiction of an embodiment of a container 200 with the bottom 240 open. The first flap 201, second flap 205, third flap 241, and fourth flap 245 swing open and closed to open or close the container 200. When the first edge 203 is adjacent to the second edge 207, and the first and second flaps 201 and 205 on top of the container 200 are in the same plane, that plane being perpendicular to the sides 230 of the container 200, the top 220 of the container is in a closed position. When the third edge 243 and fourth edge 247 are adjacent to each other, and the bottom flaps 241 and 245 are in the same plane, which is perpendicular to the sides 230 of the container 200, the bottom 240 the container 200 is in the closed position. Typically, the top 220 and bottom 240 are independent of each other and can be opened and closed separately.

In some embodiments, the container 200 is a cardboard box. In some embodiments, the cardboard is corrugated. In other embodiments, the cardboard box is paperboard. In other embodiments the container 200 is made of another semi-rigid material. The semi-rigid material may be plastic, metal, a composite, or the like.

The container 200 may vary in size and shape. The connection mechanism 100 is configured to maintain the container 200 in the closed position as long as the top 220 and bottom 240 of the box include flaps 201, 205, 241, 245 that close in the manner described above. The container 200, in some embodiments may be a small box. In other embodiments the container 200 may be a larger box. In various embodiments, the thickness of the container 200 material varies and the channel 104 varies to maintain a snug fit on the second flap 205. In some embodiment of the container 200, the container top 220, bottom 240 and sides 230 are thin. In other embodiments of container 200 the container top 220, bottom 240 and sides 230 are thick. In some examples, the rigidity of the material the container 200 is made of varies.

Figure 3:
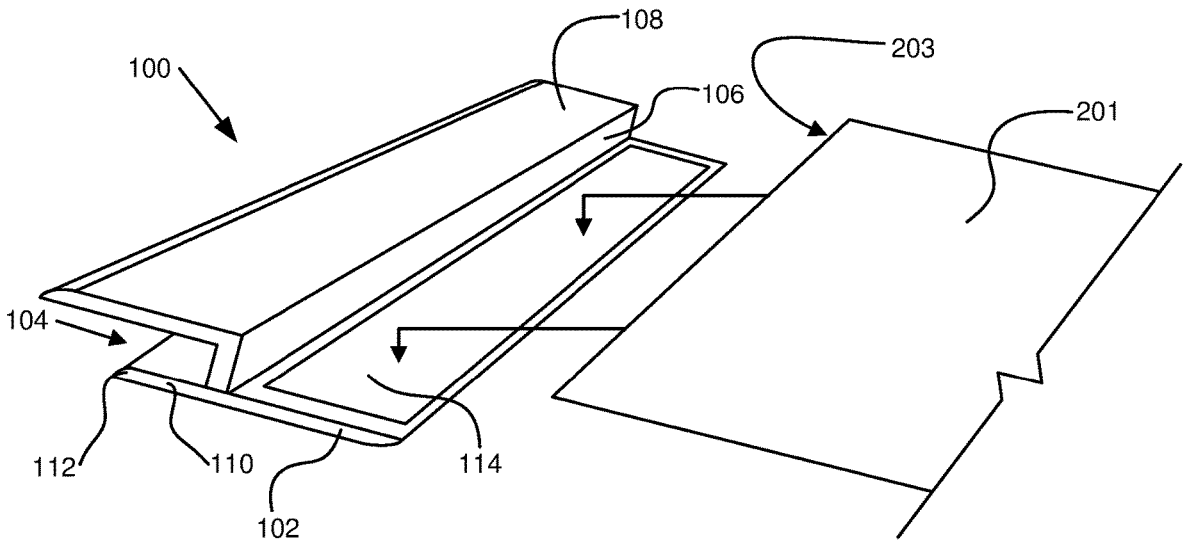
FIG. 3 is a schematic perspective view of the connection mechanism of FIG. 1A being coupled to the container of FIGS. 2A and 2B, according to various embodiments.

FIG. 3 is a schematic perspective view of the connection mechanism 100 of FIG. 1A being coupled to the container of FIGS. 2A and 2B, according to various embodiments. In FIG. 3, the tab 102 of the connection mechanism 100 is being fixedly coupled to the underside of a portion of the first flap 201 such that when the first and second flaps 201, 205 are in an open position the tab 102 remains coupled to the first flap 201. While the connection mechanism 100 may be coupled to either flap (e.g., 201, 205) of the container 200, the flap to which the connection mechanism 100 is connected is referred to herein as the first flap 201. In some embodiments, the tab 102 is fixed to the bottom of the first flap 201 along the first edge 203. In other embodiments, the tab 102 is flush to the bottom of the first flap 201. In other embodiments, the tab 102 is positioned adjacent to the channel backbone 106 of the connection mechanism 100. In some embodiments, the first edge 203 is positioned against the channel backbone 106. In other embodiments, the tab 102 is attached to the first flap 201 such that there is a small gap between the first edge 203 and the channel backbone 106.

In some embodiments, the connection mechanism 100 runs along a substantial portion of the first edge 203 of first flap 201. As used herein, the connection mechanism 100 running along a substantial portion of the first edge 203 of the first flap 201 includes the connection mechanism 100 running along at least 80% of the length of the first edge 203. In other embodiments, the connection mechanism 100 runs the entire length or width of the first edge 203. In other embodiments the connection mechanism 100 may cover an amount between 80% of the first edge 203 and the entire first edge 203. In additional embodiments, multiple connection mechanisms 100 are connected along a substantial portion of the first edge 203 of the first flap 201.

In some embodiments, the channel 104 opposite the tab 102 of connection mechanism 100 is configured to enclose a substantial portion of the second flap 205. As used herein, the channel 104 enclosing a substantial portion of the second edge 207 includes the channel 104 enclosing most of the way along the second edge 207 but not all the way along the second edge 207 within a range of at least 90 percent of the length of the second edge 207. In some examples, the channel 104 of connection mechanism 100 enclosing a substantial portion of the second edge 207 of the second flap 205 includes the channel 104 enclosing a small amount past the second edge 207, such as up to 2 percent past an end of the second edge 207. One of skill in the art will recognize appropriate variations of length of the channel 104 of the connection mechanism 100 with respect to a length of the second edge 203.

In some embodiments, a variety of fixation mechanisms can be used to couple the tab 102 to the first flap 201. In some embodiments, the fixation mechanisms are intended to be permanent and may include adhesive strips such as double-sided tape, adhesive such as glue, staples, and the like. In other embodiments, the fixation mechanisms are temporary or may be removed and may include hook and loop fasteners such as Velcro®, magnets, buttons, clamps, brads, and other fasteners that allow separation. Where the fixation mechanism is temporary or removable, the fixation mechanism is at least strong enough to maintain the tab 102 connected to the first flap 201 when the first and second flaps 201, 205 are moved to an open position.

Figure 4A:
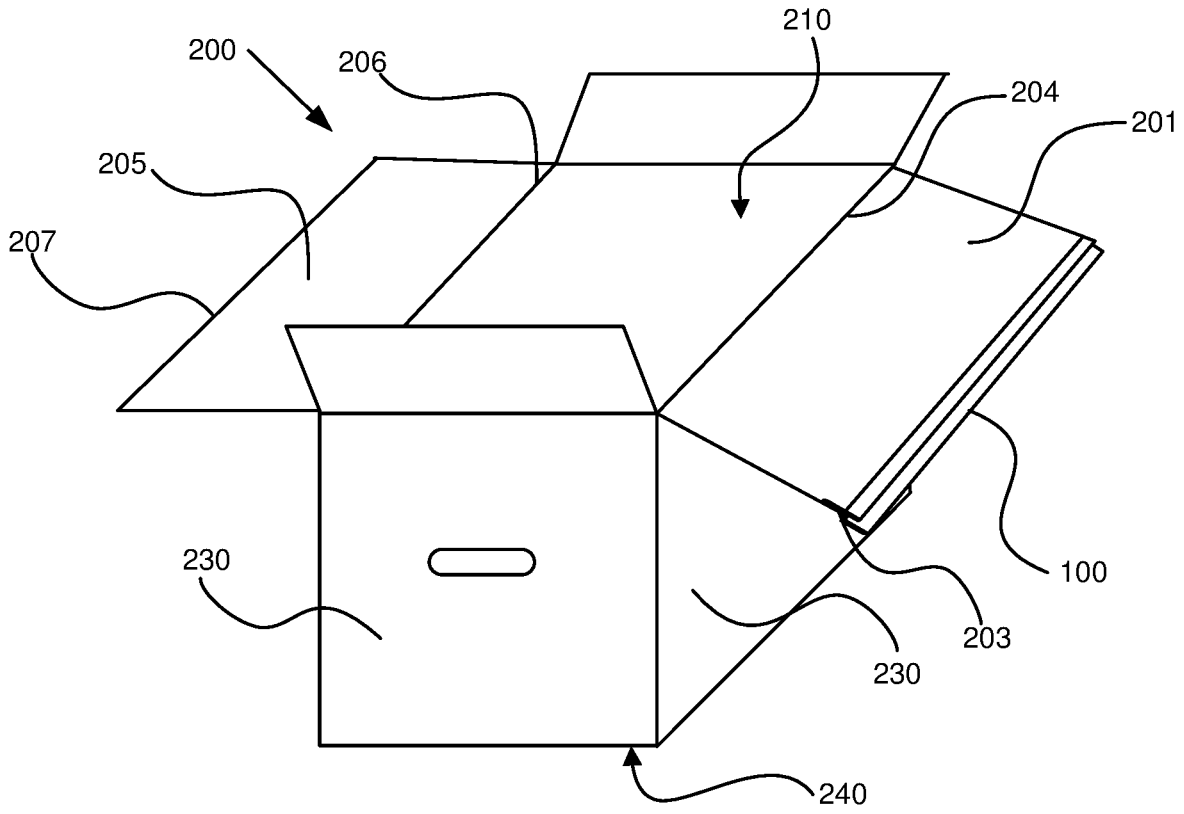
FIG. 4A is a schematic perspective view of the connection mechanism from FIG. 1A coupled to the container from FIGS. 2A and 2B while a top of the container is in an open position, according to various embodiments.
Figure 4B:
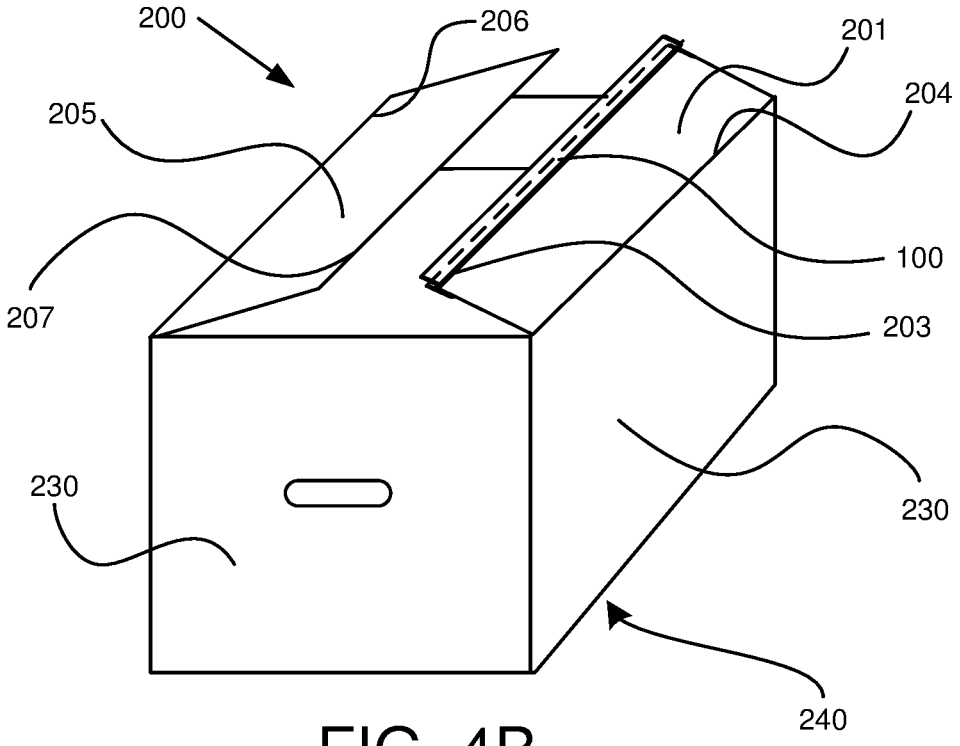
FIG. 4B is schematic perspective view of the connection mechanism from FIG. 1A coupled to the container from FIGS. 2A and 2B while a top of the container is in a partially closed position, according to various embodiments.
Figure 4C:
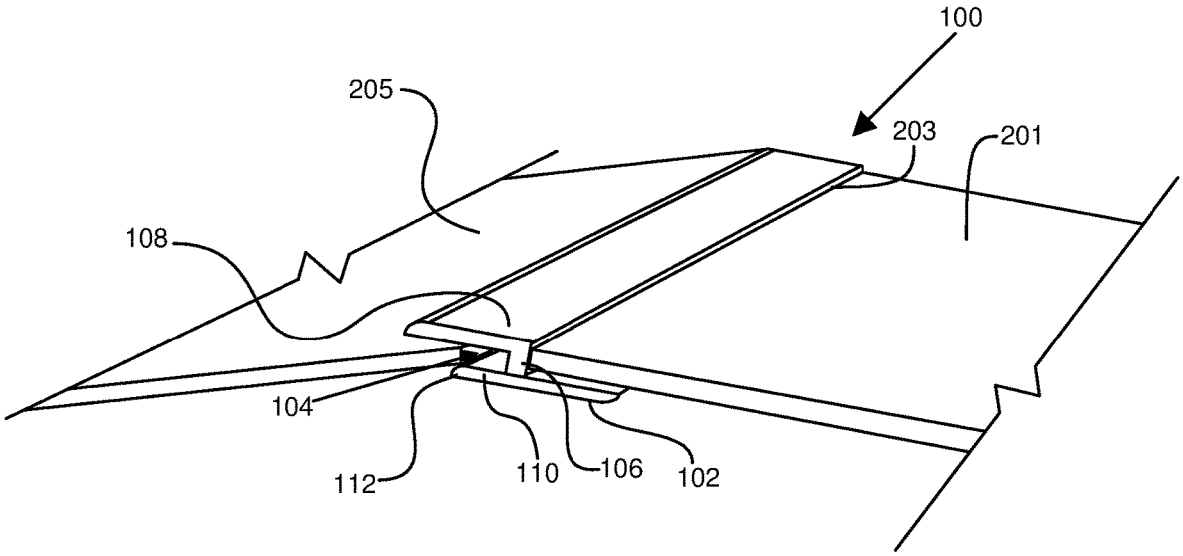
FIG. 4C is a schematic perspective view of the first and second flaps of the container of FIGS. 2A and 2B and the connection mechanism from FIG. 1A as the first and second flaps of the container approach a closed position, according to various embodiments.

FIG. 4A is a schematic perspective view of the connection mechanism 100 from FIG. 1A coupled to the container 200 from FIGS. 2A and 2B. FIG. 4B is another schematic perspective view of the connection mechanism 100 from FIG. 1A coupled to the container 200 from FIGS. 2A and 2B. FIG. 4C is a schematic perspective view of the connection mechanism 100 from FIG. 1A, fixed to the flaps 201, 205 container 200 from FIGS. 2A and 2B as the container approaches a closed position.

Referring to FIG. 4A, the container 200 is depicted with the connection mechanism 100 fixed to the first edge 203 of the first flap 201 with the container 200 the open position. The connection mechanism 100 is fixed to the first flap 201 of container 200 by fixation mechanism 114, which cannot be seen. Note that the connection mechanism 100 remains fixed to the first flap 201 when the top 220 of container 200 is in the open position.

Referring to FIG. 4B, the container 200 is depicted with the connection mechanism 100 fixed to the first edge 203 of first flap 201 with the first flap 201 and second flap 205 approaching the closed position. The second edge 207 approaches the channel 104 of the connection mechanism 100.

Referring to FIG. 4C, the first flap 201 and second flap 205 of the container 200 are being connected by the connection mechanism 100. The tab 102 of connection mechanism 100 is fixed to the underside of first flap 201 by fixation mechanism 114, as depicted in FIG. 3. The second edge 207 is guided into the channel 104 by the tapered edge 112 of the lower wall 110 and by the upper wall 108. The channel 104 is wider at the opening of the channel 104 than at interior portions of the channel 104 beyond the tapered edge 112 to facilitate easier insertion of the second flap 205 into the channel 104. The upper wall 108 is longer than the lower wall 110 to enable the second edge 207 to easily enter the channel 104. When the first flap 201, with the connection mechanism 100 attached, and the second flap 205 approach the closed position, the second edge 207 hits the upper wall 108.

As first flap 201 and second flap 205 close the top 220 of the container 200, the second edge 207 of the second flap 205 slides along the upper wall 108 until it reaches the channel 104 opening. Once the second edge 207 of the second flap 205 reaches the channel 104 opening, the tapered edge 112 of the lower wall 110 then guides the second edge 207 into the channel 104 opening. The tapered edge 112 of the lower wall 110 provides a wider space for second edge 207 to enter the channel 104. The distance between the tapered edge 112 of the lower wall 110 and the upper wall 108 at the channel 104 opening is greater than the distance between the lower wall 110 and the upper wall 108 at the interior of the channel 104, past the tapered edge 112. The tapered edge 112, in some embodiments, helps to prevent creases or bends in the second flap 205 as the second flap 205 entered channel 104. Creases or bends damage the second flap 205 and possibly making the container 200 unusable. Once second flap 205 enters the channel, the second flap 205, in some embodiments, is held in place by a friction fit with the second flap 205 resting between the lower wall 110 and the upper wall 108. Once encompassed in the channel 104, the friction fit helps to maintain the second flap 205 within the channel 104 until acted upon by an outside force that overcomes the friction fit.

In some embodiments, when the second flap 205 is maintained in the channel 104 by friction fit, the second flap 205 interfacing with both the upper wall 108 and the lower wall 110, the upper wall 108 sits flush on top of second flap 205 and the lower wall 110 rests flush to the bottom of the second flap 205. The second edge 207 interfaces with the channel backbone 106 at the closed end of the channel 104.

In some embodiments the dimensions of the channel 104 vary to accommodate various containers sizes. The length of the lower wall 110 and the upper wall 108 may vary, creating channels 104 of various depths. A smaller container 200 may require a shallower channel 104 while a larger container 200 may require a deeper channel 104. A more rigid container 200 may require a shallower channel 104, to prevent folding of the second flap 205 as it enters the channel 104, while a less rigid container 200 may require a deeper channel 104 to maintain a sufficiently strong friction fit. In some embodiments the width of the channel 104 may vary. The distance between the lower wall 110 and the upper wall 108 is adjusted to achieve the desired channel depth.

The channel 104, in some embodiments, is slightly wider than the second flap 205 to achieve a weak friction fit. In other embodiments, the channel 104 is the same width as the second flap 205 is thick if a strong friction fit is desired. The channel 104 may be less wide than the second flap 205 is thick if an even stronger friction fit is desired. Thus, the channel 104 may accommodate containers 200 of various wall and flap thickness, various size, and various rigidity. Improper channel 104 width or depth may lead to damage to the container 200 and ineffective coupling of first flap 201 and second flap 205. Ineffective coupling of first flap 201 and second flap 205 may not maintain the container top 220 in the closed position. The fixation mechanism 114 beneficially creates a stronger coupling between the tab 102 and the first flap 201 than the friction fit coupling between the second flap 205 and the channel 104. Thus, the channel 104 is able to release the second flap 205 while the connection mechanism 100 remains fixed to the first flap 201.

While the connection mechanism 100 of FIGS. 1A-1C, 3, and 4A-4C are depicted connected to top flaps 201, 205 of a container 200, embodiments described herein are applicable to a connection mechanism 100 being connected to bottom flaps 241, 245 of the container 200. In some embodiments, the container 200 includes two connection mechanisms 100 where one is on top and one is on the bottom.

Figure 5:
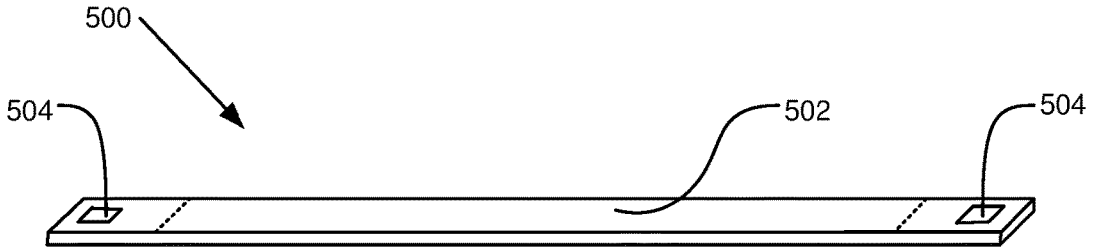
FIG. 5 is a schematic perspective view of a strap for maintaining a container in a closed position, according to various embodiments.
Figure 6:
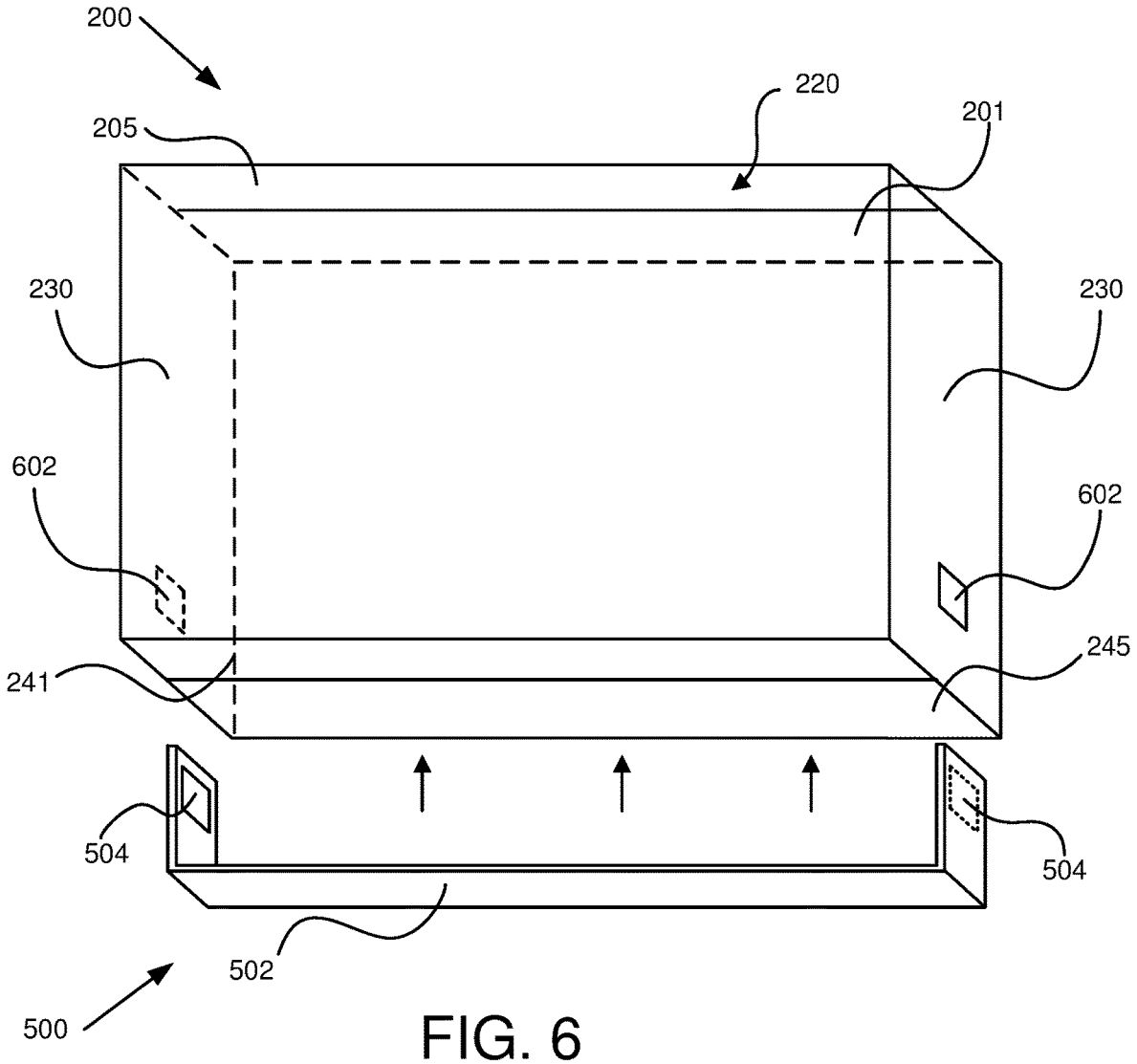
FIG. 6 is a schematic perspective view of the strap from FIG. 5 being coupled to the container from FIGS. 2A and 2B, according to various embodiments.

FIG. 5 is a schematic perspective view of a strap 500, according to various embodiments. FIG. 6 is a schematic perspective view of the strap 500 of FIG. 5 being coupled to the container 200 from FIGS. 2A and 2B. Referring to FIGS. 5 and 6, the strap 500, which is detachably couplable to the bottom 240 of the container 200, is shown. The strap 500 includes at least two coupling mechanisms 504, at least one coupling mechanism 504 is fixedly coupled to each end of the strap 500, and a strap body 502. The coupling mechanism 504 corresponds to a complementary coupling mechanism 602 that is fixedly coupled to opposite sides 230 of the container 200. In some embodiments, the coupling mechanism 504 and complementary coupling mechanism 602 may be a hook and loop mechanism, a button mechanism, a magnetic mechanism, or some other detachable coupling mechanism.

In some embodiments, the coupling mechanism 504 is fixedly fixable to the strap 500, the complementary coupling mechanism 602 is fixedly fixable to the side 230 of container 200, and the coupling mechanism 504 and complementary coupling mechanism 602 are detachably couplable to each other. In some embodiments, the coupling mechanism 504 and the complementary coupling mechanism 602 are fixed to the strap 500 and the container 200 using an adhesive such as glue or a mechanical fastening mechanism such as a staple. In some embodiments, the strap body 502 is made of a pliable material such that it may contour to the bottom 240 and sides 230 of the container 200. In some embodiments the strap 500 is made of plastic. In other embodiments the strap may be made of metal, fabric, a composite, or the like. The complementary coupling mechanisms 602 and the coupling mechanisms 504 are fixed at positions on opposite ends of the strap 500 and opposite sides 230 of container 200, respectively, such that when the coupling mechanisms 504 are detachably fixed to the complementary coupling mechanisms 602, the strap body 502 is tight to the bottom 240 and portions of the sides 230 of the container 200.

In some embodiments, the strap 500, when detachably coupled to the container 200, rests flush against the third flap 241 and fourth flap 245 of the container 200. The strap 500 covers a length of the third edge 243 and the fourth edge 247 to maintain the bottom 240 of the container 200 in a closed position. In some embodiments the strap 500 is made of a rigid material, such as metal, and the strap 500 may include sectioning mechanisms such as hinges to allow the strap 500 to fold along the third edge 243 and the fourth edge 247 to maintain the bottom 240 of the container 200 in a closed position. The strap 500 maintains third flap 241 and fourth flap 245 of the container 200 in a closed position such that the container 200 can only be opened when the strap 500 is removed by releasing the coupling mechanism 504 from the complementary coupling mechanism 602. The strap 500 can be removed from the container by separating the coupling mechanism 504 and the complementary coupling mechanism 602 using a pulling force normal to the side 230 of the container where the coupling mechanism 504 is fixed. When released, the coupling mechanism 504 remains attached to the strap 500 and the complementary coupling mechanism 602 remains coupled to the side 230 of the container 200. Removal of the strap 500 from the bottom 240 of container 200 will not damage the container, allowing the container 200 to be reused repeatedly.

Figure 7:
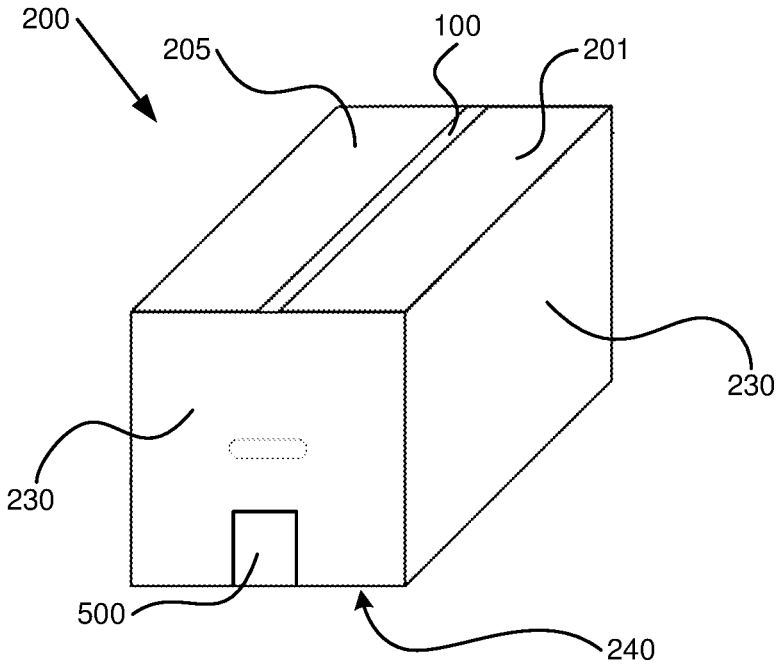
FIG. 7 is a schematic perspective view of the connection mechanism of FIGS. 1A-1C and the strap of FIG. 5 coupled to the container of FIGS. 2A and 2B, according to various embodiments.

FIG. 7 is a schematic perspective view of the connection mechanism 100 of FIGS. 1A-1C and the strap 500 of FIG. 5 coupled to the container 200 of FIGS. 2A and 2B, according to various embodiments. FIG. 7 depicts the container 200 with both connection mechanism 100 and strap 500 coupled to the container 200 maintaining the first flap 201, the second flap 205, the third flap 241, and the fourth flap 245 in the closed position, according to various embodiments. The connection mechanism 100 and the strap 500 add structural strength to the container 200, enabling greater stacking ability and increasing the durability of the container.

When the connection mechanism 100 releases the second flap 205 from the channel 104, and the strap 500 is detached from the bottom 240 of the container 200, the container 200 may be disassembled and folded flat for convenient storage. When the first flap 201, second flap 205, third flap 241, fourth flap 245, top side flaps 208, and bottom side flaps 248 are in the open position, the container 200 may be flattened. When flattened the connection mechanism 100 remains fixed to first flap 201 and the complementary coupling mechanisms 602 remain fixed to opposite sides 230 of the container 200. The detached strap 500, with coupling mechanisms 504 still fixed to the strap 500, can be stored separately or may be connected to a complementary coupling mechanism 602 and be stored with the container 200. The container 200 can thus be easily disassembled for storage without damaging the container 200. When needed again, the container 200 can be reassembled and reused.

Figure 8A:
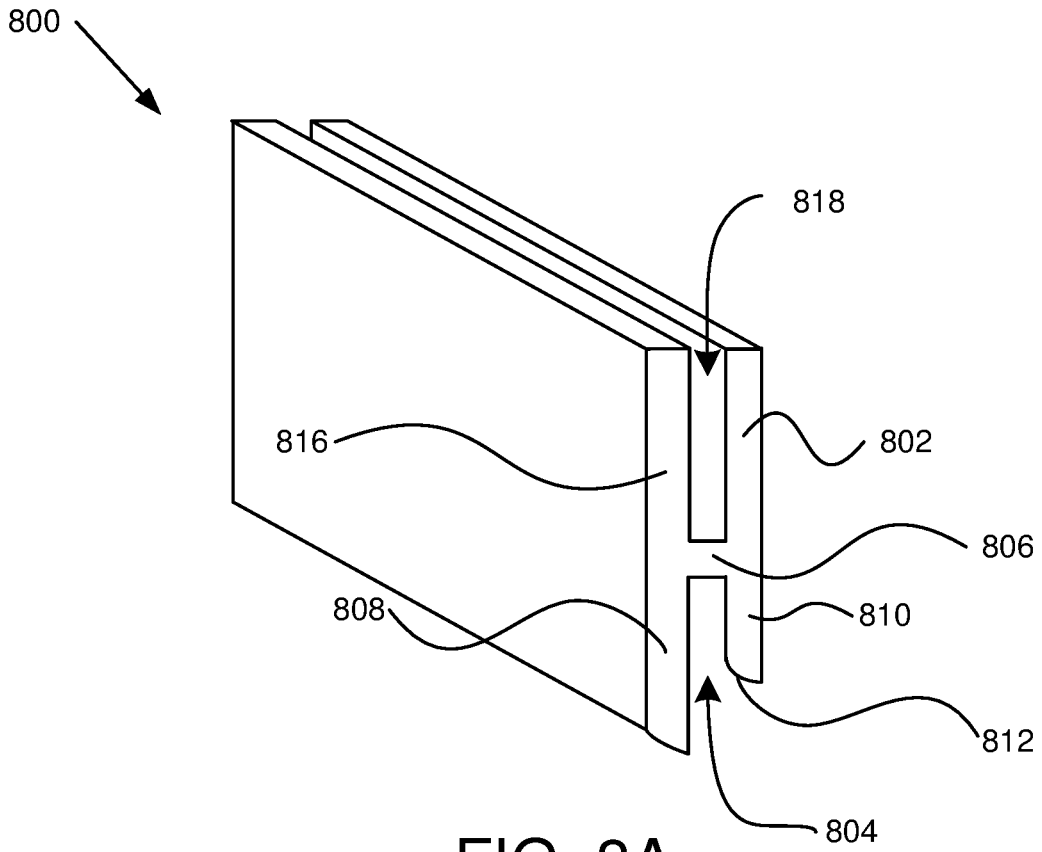
FIG. 8A is a schematic perspective view of another connection mechanism for selectively maintaining a container in a closed position, according to various embodiments.

FIG. 8A depicts an embodiment of a connection mechanism 800, according to some examples. Referring to FIG. 8A, connection mechanism 800 serves a similar purpose to connection mechanism 100 of FIG. 1A. In some embodiments, connection mechanism 800 includes a first channel 804 and a second channel 818 opposite the first channel 804. In some embodiments, the first channel 804 includes a lower wall 810 and an upper wall 808. The upper wall 808, in some embodiments, is longer than the lower wall 810 and the lower wall has a tapered edge 812, as depicted in the connection mechanism 100 of FIGS. 1A-1C. The first channel 804, in some embodiments, is wider at the opening of the first channel 804 than at interior portions of the first channel 804 beyond the tapered edge 812. The first channel 804 has an open end and a closed end, the closed end is closed by a channel backbone 806. The second channel 818, includes an upper wall 816 and a lower wall 802. The second channel 818 also includes an open end and a closed end. The closed end is the channel backbone 806. The second channel 818 encompasses a portion of the first flap 201 of the container 200. In some embodiments, the second channel 818 is deeper than the first channel 804.

Figure 8B:
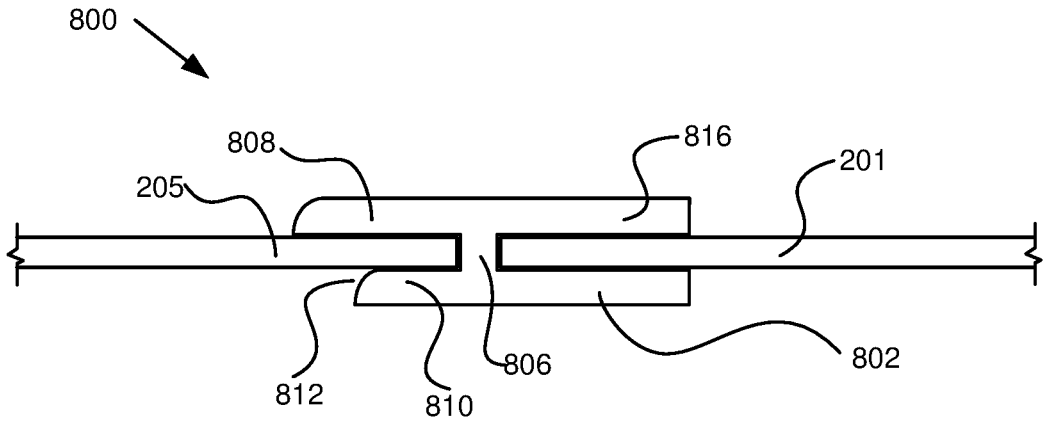
FIG. 8B is a representation of another embodiment of the connection mechanism coupled to the container from FIGS. 2A and 2B, according to various embodiments.

FIG. 8B depicts an embodiment of the connection mechanism 800 coupled to first flap 201 and second flap 205 of the container 200, according to some examples. Referring to FIG. 8B, the second channel 818 is coupled to first flap 201 by a friction fit, but may also be coupled using an adhesive or some other mechanism to maintain the first flap 201 in the second channel 818. In some embodiments, the lower wall 802 is flush to the bottom of the first flap 201, the upper wall 816 is flush to the first flap 201, and the first edge 203 of the first flap 201 interfaces with the channel backbone 806 of the connection mechanism 800. The first channel 804 is couplable to second flap 205 by a friction fit in a similar way as the connection mechanism 100 described above.

The second edge 207 of the second flap 205 is guided into the first channel 804 by the tapered edge 812 of the lower wall 810 and the upper wall 808. In some embodiments, the upper wall 808 is longer than the lower wall 810 to enable the second edge 207 to easily enter the first channel 804. When the first flap 201, with the connection mechanism 800 attached, and the second flap 205 approach the closed position, the second edge 207 hits the upper wall 808 of the connection mechanism 800. As the first flap 201 and second flap 205 close the top 220 of the container 200, the second edge 207 of the second flap 205 slides along the upper wall 808 until it reaches the first channel 804 opening.

Once the second edge 207 of the second flap 205 reaches the first channel 804 opening, the tapered edge 812 of the lower wall 810 guides the second edge 207 into the first channel 804 opening. The tapered edge 812 of the lower wall 810 provides a wider space for second edge 207 to enter the first channel 804. As the second flap 205 enters the first channel 804, the first channel 804 creates a friction fit on the second flap 205 with the second flap 205 resting between the lower wall 810 and the upper wall 808. Once encompassed in the first channel 804, the second flap 205 typically will be maintained in the first channel 804 by friction unless acted upon by an outside force that overcomes the force of friction.

When the second flap 205 is maintained in the first channel 804 by friction fit, the second flap 205 interfaces with both the upper wall 808 and the lower wall 810, the upper wall 808 sits flush on top of second flap 205 and the lower wall 810 rests flush to the bottom of the second flap 205. In some embodiments, the second edge 207 interfaces with the channel backbone 806 at the closed end of the first channel 804.

Where the second channel 818 is deeper than the first channel 804 and/or the friction fit of the second channel 818 is greater than the friction fit of the first channel 804, the friction force applied by the second channel 818 to the first flap 201 when the flap is inserted into the second channel 818 is greater than the friction force applied by the first channel 804 on the second flap 205 when the second flap 205 is inserted into first channel 804. Thus, when an opening force, normal to the top 220 of the container 200, is applied, the second flap 205 will release from first channel 804 and the first flap 201 will maintain its position in the second channel 818 of the connection mechanism 800 because of the greater friction force of second channel 818. The second channel 818 can be configured to apply different friction forces by varying the width and depth of the second channel 818.

Figure 8C:
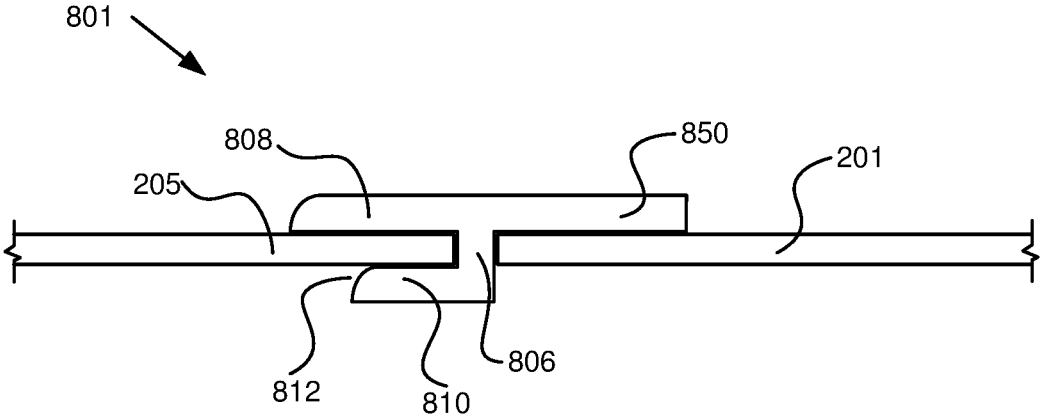
FIG. 8C is side cross section view of another connection mechanism coupled to a top side of a flap of the container from FIGS. 2A and 2B, according to various embodiments.

FIG. 8C is side cross section view of another connection mechanism 801 coupled to a top side of a flap 201 of the container from FIGS. 2A and 2B, according to various embodiments. The connection mechanism 801 includes a tab 850 configured to connect to a top side of the first flap 201. The tab 850 is substantially similar to the tab 102 of FIGS. 1A-1C except connected to an upper side of a channel backbone 806. The tab 850 includes a fixation mechanism 114 substantially similar to the fixation mechanism 114 described above with respect to FIG. 3. The connection mechanism 801 includes a first channel 804 as depicted in FIG. 8A. The connection mechanism 801 includes a lower wall 810, an upper wall 808, and tapered edge 812, as described above in relation to the connection mechanism 800 of FIGS. 8A and 8B. The connection mechanism 801 is substantially similar to the connection mechanism 100 of FIGS. 1A-1C except that the tab 102 of FIGS. 1A-1C is moved up and is tab 850.

Figure 9A:
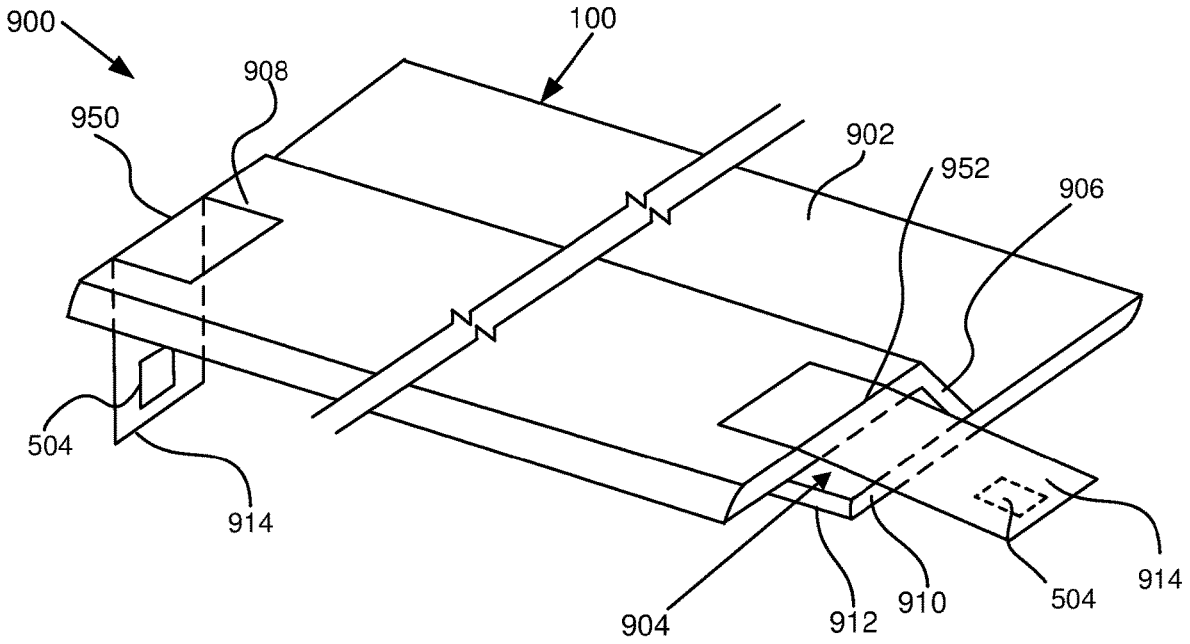
FIG. 9A is a perspective view of an alternate connection mechanism for selectively maintaining a container in a closed position, according to various embodiments.
Figure 9B:
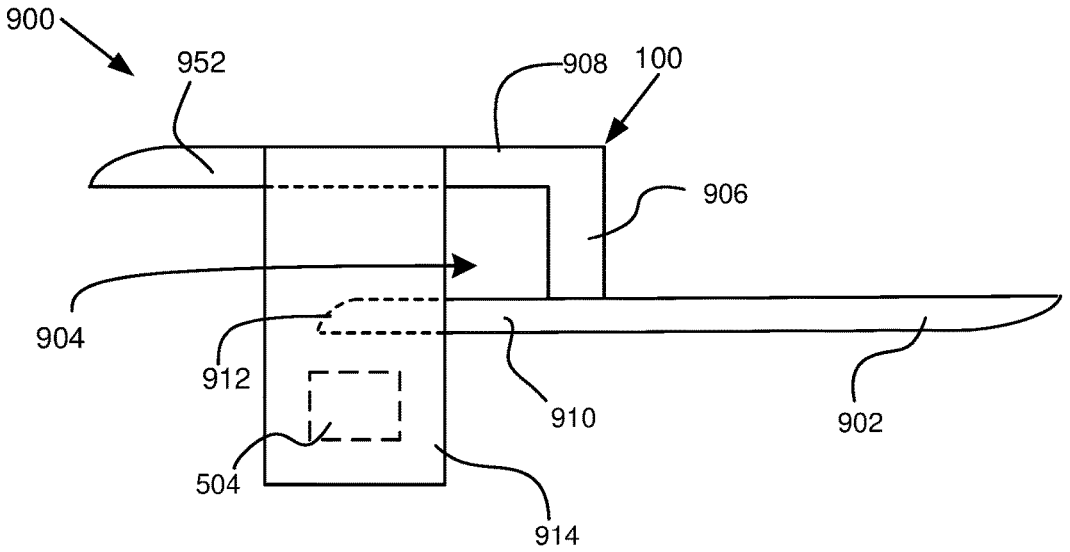
FIG. 9B is a side view of the alternate connection mechanism of FIG. 9A, according to various embodiments.
Figure 9C:
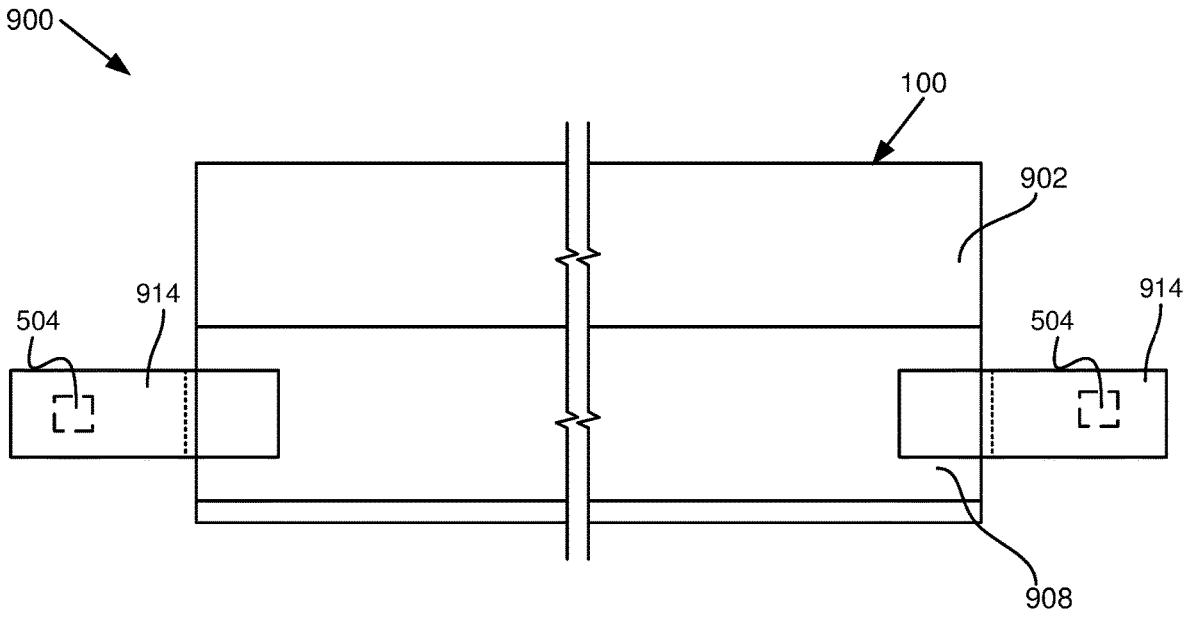
FIG. 9C is a top view of the alternate connection mechanism of FIG. 9A, according to various embodiments.
Figure 9D:
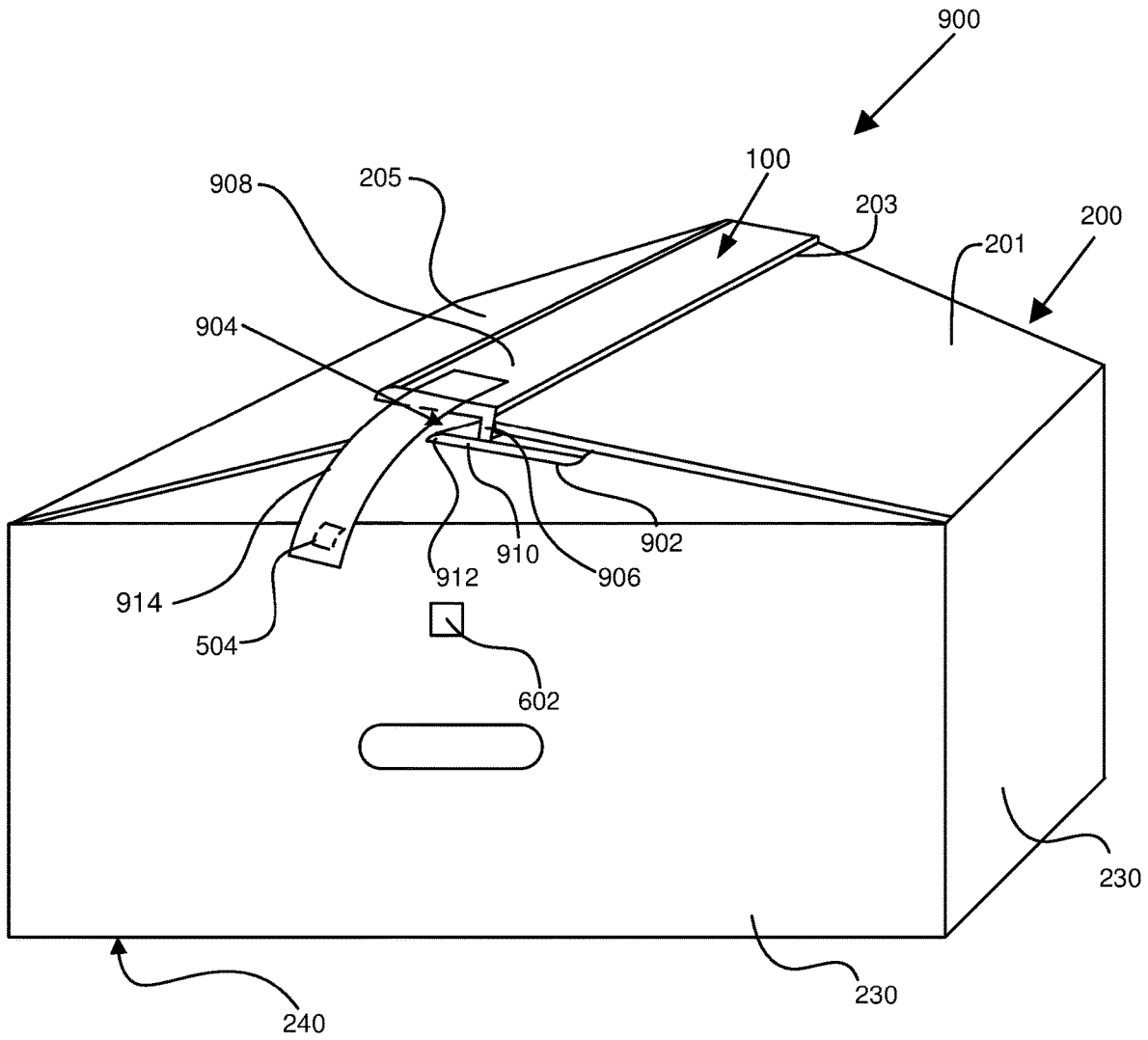
FIG. 9D is a perspective view of the first and second flaps of a container of FIGS. 2A and 2B and the alternate connection mechanism from FIG. 9A as the first and second flaps of the container approach a closed position, according to various embodiments.

FIG. 9A depicts an embodiment of an alternate connection mechanism 900 for selectively maintaining a container in a closed position, according to some examples. The alternate connection mechanism 900 is depicted with a break line in FIG. 9A indicating additional length. FIG. 9B is a side view of the alternate connection mechanism 900 from FIG. 9A. FIG. 9C is a top view of the alternate connection mechanism 900 of FIG. 9A. FIG. 9D is a perspective view of the first and second flaps of a container of FIGS. 2A and 2B and the alternate connection mechanism 900 from FIG. 9A as the first and second flaps of the container approach a closed position, according to various embodiments.

In some embodiments, the alternate connection mechanism 900 of FIGS. 9A-D serves a similar purpose to the connection mechanism 100 of FIG. 1A. In some embodiments, the alternate connection mechanism 900 is used to keep the top 220 of the container 200 closed. In some embodiments, the alternate connection mechanism 900 is used to keep the bottom 240 of the container 200 closed. In some embodiments, the alternate connection mechanism 900 is used to keep the top 220 of the container 200 closed and another mechanism is used to keep the bottom closed, such as the connection mechanism 100 from FIG. 1A, the strap 500 of FIG. 6, or the like.

Figure 11:
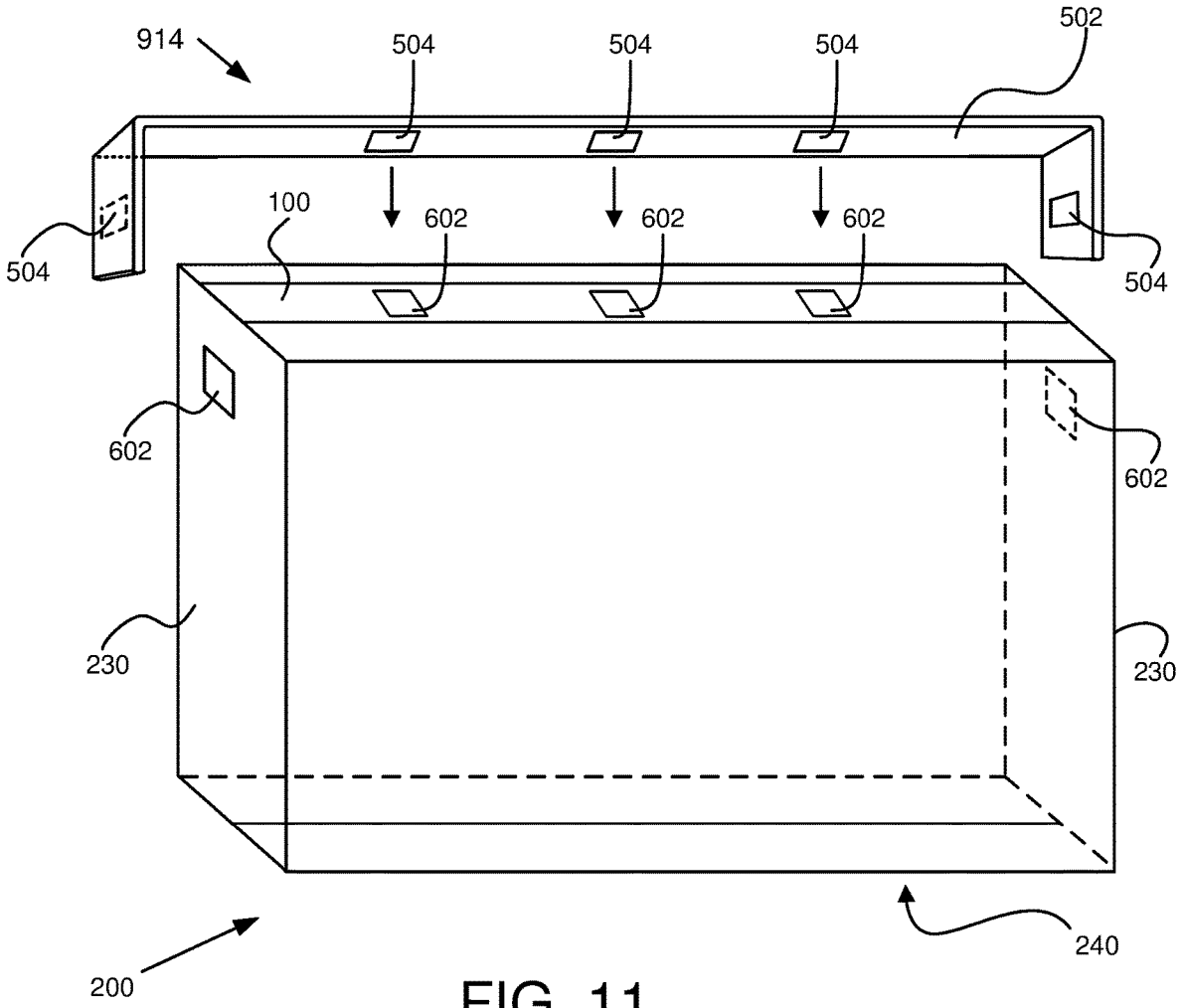
FIG. 11 is a perspective view of a strap being coupled to the connection mechanism and the sides of the container, according to various embodiments.

In some embodiments, the alternate connection mechanism 900 includes a connection mechanism 100 of FIGS. 1A-C and one or more straps 914 extending from one or both sides 950, 952 of an upper wall 908 of the connection mechanism 100 to at least one of opposite sides 230 of the container 200. The one or more straps 914 are couplable to one or both of the opposite sides 230 of the container 200. While the straps 914 are depicted with a width that is less than a width of the upper wall 908, in other embodiments, the straps 914 may be wider and may be as wide as the upper wall 908. In some embodiments the strap 914 is permanently fixed to the connection mechanism 100, for example to the upper wall 908. In other embodiments the strap 914 is removably coupled to the connection mechanism 100. In some embodiments the one or more straps 914 are a single strap 914 coupled to the connection mechanism 100, as depicted in FIG. 11, where the length of the single strap 914 exceeds the length of the connection mechanism 100 and the single strap 914 is configured to be couplable to both of the opposite sides 230 of the container 200. In other embodiments the one or more straps 914 are one of two straps 914, where each of the two straps 914 is couplable to the connection mechanism 100 and to one of the opposite sides 230 of the container 200, as depicted in FIG. 12B.

In some embodiments, the one or more straps 914 are fixed to the connection mechanism 100 using adhesive strips such as double-sided tape, adhesives such as glue, or mechanical fasteners such as staples, hinges, and the like. In some embodiments, the one or more straps 914 are fused to the connection mechanism 100 or are formed as part of the connection mechanism 100. In some embodiments a slot may be made in the upper wall 908 of the alternate connection mechanism 900 to allow a strap 914 to slide through. In some embodiments, the alternate connection mechanism 900 has one or more straps 914 fixed to the connection mechanism 100 during assembly using pre-applied adhesive strips. In other embodiments, the one or more straps 914 are fixed to pre-applied adhesive strips that are provided separately from connection mechanism 100 and the user fixes the one or more straps 914 to the connection mechanism 100 using the pre-applied adhesive strips.

In some embodiments, the alternate connection mechanism 900, includes a tab 902 and a channel 904. The tab 902 and the channel 904 being opposite each other. The channel 904 includes a lower wall 910 and an upper wall 908 with the channel 904 there between. The channel 904 has an open end and a closed end. The closed end is closed off by a channel backbone 906. The tab 902 protrudes from the opposite side of the channel backbone 906. The channel backbone 906 provides structure and rigidity to the connection mechanism 900. The tab 902 is configured to interface with the bottom face of a top container flap 201 of the container 200. The tab 902 is fixedly coupled to the first flap 201. When the first flap 201 is coupled, the tab 902 is flush to a portion of the bottom of the first flap 201 near a first edge 203 of the first flap 201. In some embodiments, the lower wall 910 includes a tapered edge 912. In some embodiments, all edges of the connection mechanism 900 are tapered. Having a tapered edge prevents the connection mechanism 900 from catching or snagging on surrounding objects and allows the surrounding objects to slide past the connection mechanism 900. In some embodiments the angle between the channel backbone 906 and the upper channel wall 908 and the lower channel wall 910 may be 90 degrees. In other embodiments the angle may be more than or less than 90 degrees.

In some embodiments the one or more straps 914 are removably coupled to the connection mechanism 100 and may be coupled to the connection mechanism 100 using hook and loop fasteners such as Velcro®, magnets, buttons, clamps, brads, and other fasteners that allow separation. The one or more straps 914, in some embodiments are made of a pliable material such that the straps contour to the top 220 or bottom 240 and sides 230 of the container 200. In other embodiments, the one or more straps 914 are made of a rigid material such as metal, plastic, a composite, or the like. When the one or more straps 914 are made of a rigid material, such as metal, the one or more straps 914 may include sectioning mechanisms such as hinges to allow the one or more straps 914 to contour along the to the top 220 or bottom 240 and sides 230 of the container 200. In other embodiments, the one or more straps 914 are similar to the strap 500 from FIGS. 5 and 6.

Referring to FIG. 9D, the first flap 201 and the second flap 205 of the container 200 are being connected by the alternate connection mechanism 900 in a similar manner to connection mechanism 100 as shown in FIG. 4C. In other embodiments, the alternate connection mechanism 900 is used to connect flaps 241, 245 on the bottom 240 of the container 200. As the container 200 is closed, strap 914 may be selectively coupled to the side opposite sides 230 of the container 200.

In some embodiments, the one or more straps 914 include a coupling mechanism 504 and the container may include a complementary coupling mechanism 602 similar to those depicted in FIGS. 5 and 6. In some embodiments, once the connection mechanism 100 of the alternate connection mechanism 900 is connected to the first flap 201 and the second flap 205, the one or more straps 914 are connected to the sides 230 by fixing the coupling mechanism 504, fixed to the strap 914, to a complementary coupling mechanism 602, fixed to the respective side 230 of container 200. In some embodiments, the coupling mechanisms 504 fixed to the one or more straps 914 and the complementary coupling mechanisms 602 fixed to the sides 230 of the container 200 are positioned such that when the coupling mechanisms 504 and complementary coupling mechanism 602 are detachably fixed together, the one or more straps 914 are tight enough to the portions of the sides 230 of the container 200 to selectively close the top 220 of the container 200.

Figure 10A:
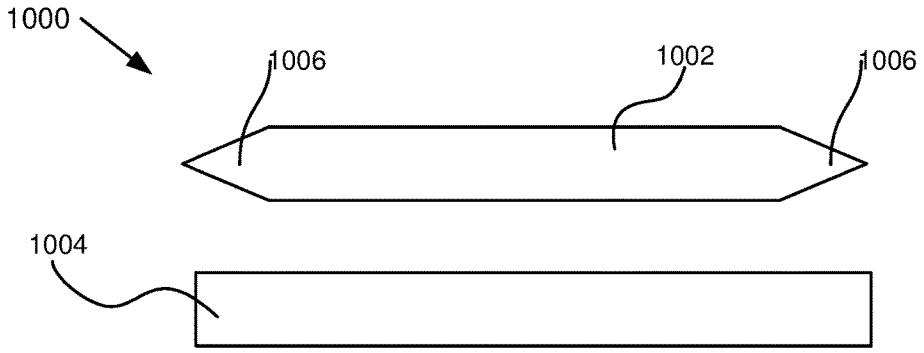
FIG. 10A is a perspective view of a hook and loop fastener for selectively maintaining a container in a closed position, according to various embodiments.

FIG. 10A is a perspective view of a hook and loop fastener 1000 for selectively maintaining a container in a closed position, according to various embodiments. In other embodiments, the hook and loop fastener 1000 includes a first portion 1002 couplable to a second portion 1004, where the first portion 1002 has tapered edges 1006 on each end and the second portion 1004 has ends configured to connect with corresponding tapered edges 1006 of the first portion 1002 that are wider than the tapered edges 1006 of the first portion 1002. An advantage to the hook and loop fastener portions 1002, 1004 of FIG. 10A is that pulling the hook and loop fastener portions 1002, 1004 apart is less likely to tear the container 200.

In other embodiments, the first portion 1002 includes the hook portion of the hook and loop fastener 1000 and the second portion 1004 includes the loop portion of the hook and loop fastener 1000. In other embodiments, the first portion 1002 includes the loop portion of the hook and loop fastener 1000 and the second portion 1004 includes the hook portion of the hook and loop fastener 1000. In other embodiments, the coupling hook and loop fastener 1000 includes a hook and loop fastener such as Velcro®.

Figure 10B:
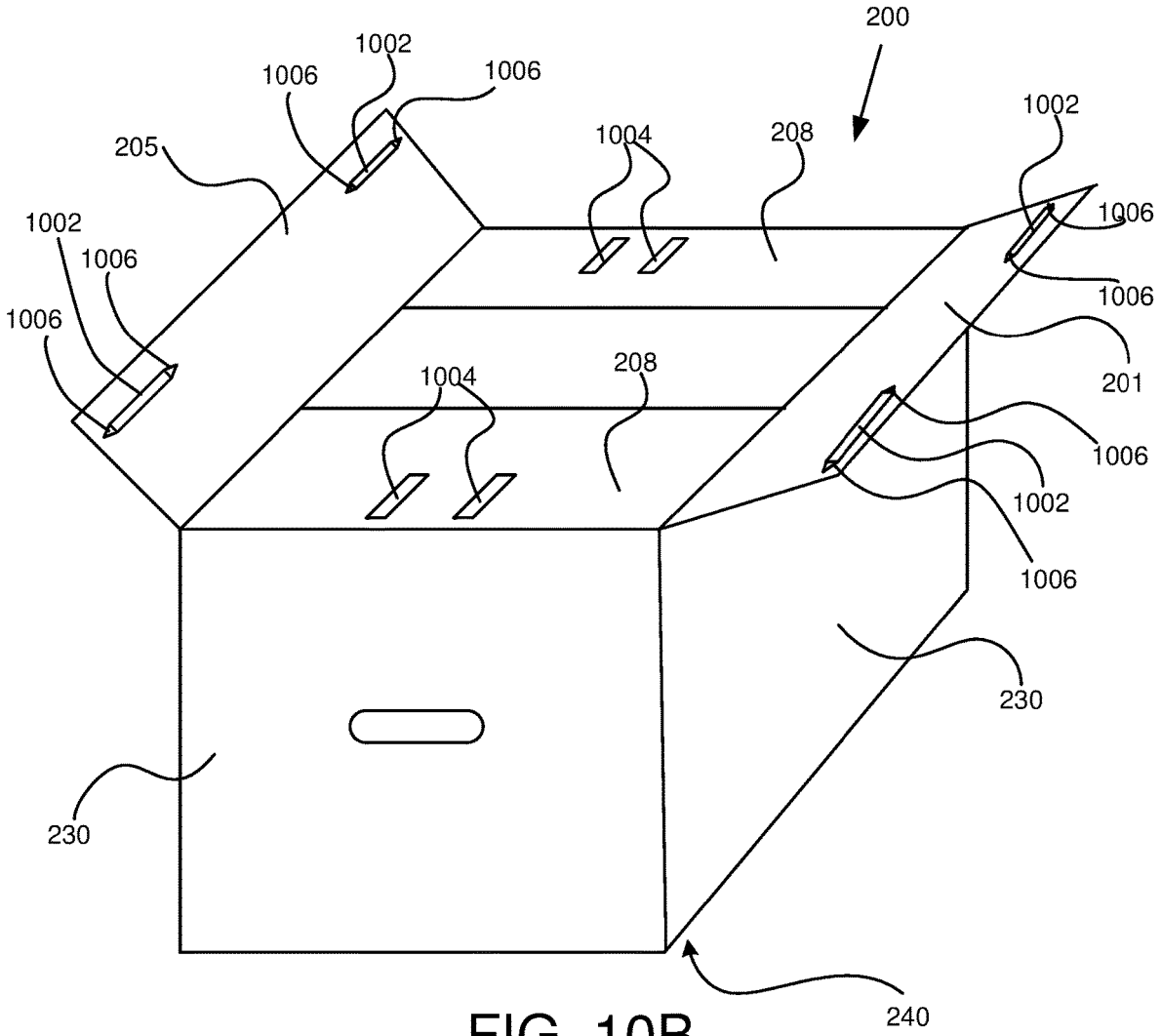
FIG. 10B is a perspective view of the hook and loop fastener coupled to the container of FIGS. 2A and 2B while a top of the container is in a partially closed position, according to various embodiments.

FIG. 10B is a schematic perspective view of the hook and loop fasteners 1000 coupled to the container 200 of FIGS. 2A and 2B while a top 220 of the container 200 is in a partially closed position, according to various embodiments. In some embodiments, at least two of the first portions 1002 of the hook and loop fasteners 1000 are fixedly fixed to the flaps 201, 205 of the top 220 of the container 200 and at least two of the second portions 1004 of the hook and loop fasteners 1000 are fixedly fixed to the side flaps 208 of the container 200 to selectively close the top 220 of the container 200. In other embodiments, the hook and loop fasteners are fixed to the flaps 241, 245 and side flaps 248 to selectively close the bottom 240 of the container 200.

In other embodiments, the hook and loop fasteners 1000 are used to selectively close one of the top 220 or bottom 240 of the container 200 and a different mechanism, such as the connection mechanism 100 from FIG. 1A, is used to selectively close the remaining of the top 220 or bottom 240 of the container 200. In other embodiments, the hook and loop fastener 1000 portions 1002, 1004 are positioned so that when the flaps 201, 205 are closed on top of side flaps 208 the first portions 1002 and second portions 1004 are detachably fixed and hold the top of the container 200 selectively closed. While the first portions 1002 with the tapered edges 1006 are depicted on the first and second flaps 201, 205 and the second portions 1004 are depicted on the side flaps 208, in other embodiments, the first portions with the tapered edges 1006 are positioned on the side flaps 208 and the second portions 1004 are positioned on the first and second flaps 201, 205.

FIG. 11 is a perspective view of a strap 914, which may be similar to the strap 500 from FIG. 5, being coupled to the connection mechanism 100 of FIGS. 1A-1C and the sides 230 of the container 200 of FIGS. 2A and 2B, according to various embodiments. In some embodiments the strap 914 is configured to be detachably couplable to the connection mechanism 100 and the opposite sides 230 of the container 200 such that the strap 914 maintains the top 220 and/or the bottom 240 of the container 200 in the closed position. In some embodiments a different connection mechanism may be used in place of the connection mechanism 100. In some embodiments, the strap body 502 may include multiple coupling mechanisms 504 spaced between the coupling mechanisms 504 fixed to the ends of the strap body 502. In other embodiments, only one coupling mechanism 504 is fixed to the strap body 502 between the coupling mechanisms 504 fixed to the ends of the strap body 502. In some embodiments, only one coupling mechanism 504 is fixed to the ends of the strap body 502. In other embodiments, multiple coupling mechanisms 504 are fixed to the ends of the strap body.

In some embodiments, the sides 230 of the container 200 include a single complementary coupling mechanism 602 fixed to each of the opposite sides 230 of the container 200. In other embodiments, multiple complementary coupling mechanisms 602 are fixed to each of the opposite sides 230 of the container 200. In some embodiments the connection mechanism 100 may have a single complementary coupling mechanism 602 fixed to it. In other embodiments multiple complementary coupling mechanisms may be fixed to the connection mechanism 100. In some embodiments the coupling mechanisms 504 fixed to the strap 500 and the complementary coupling mechanisms 602 fixed to the opposite sides 230 of the container 200 are positioned so when the coupling mechanisms 504 and the complementary coupling mechanisms 602 are detachably coupled, the strap 500 is flush with the sides 230 of the container 200.

Figure 12A:
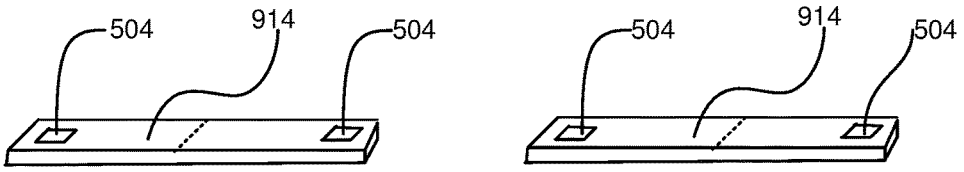
FIG. 12A is a view of two straps for maintaining a container in a closed position, according to various embodiments.
Figure 12B:
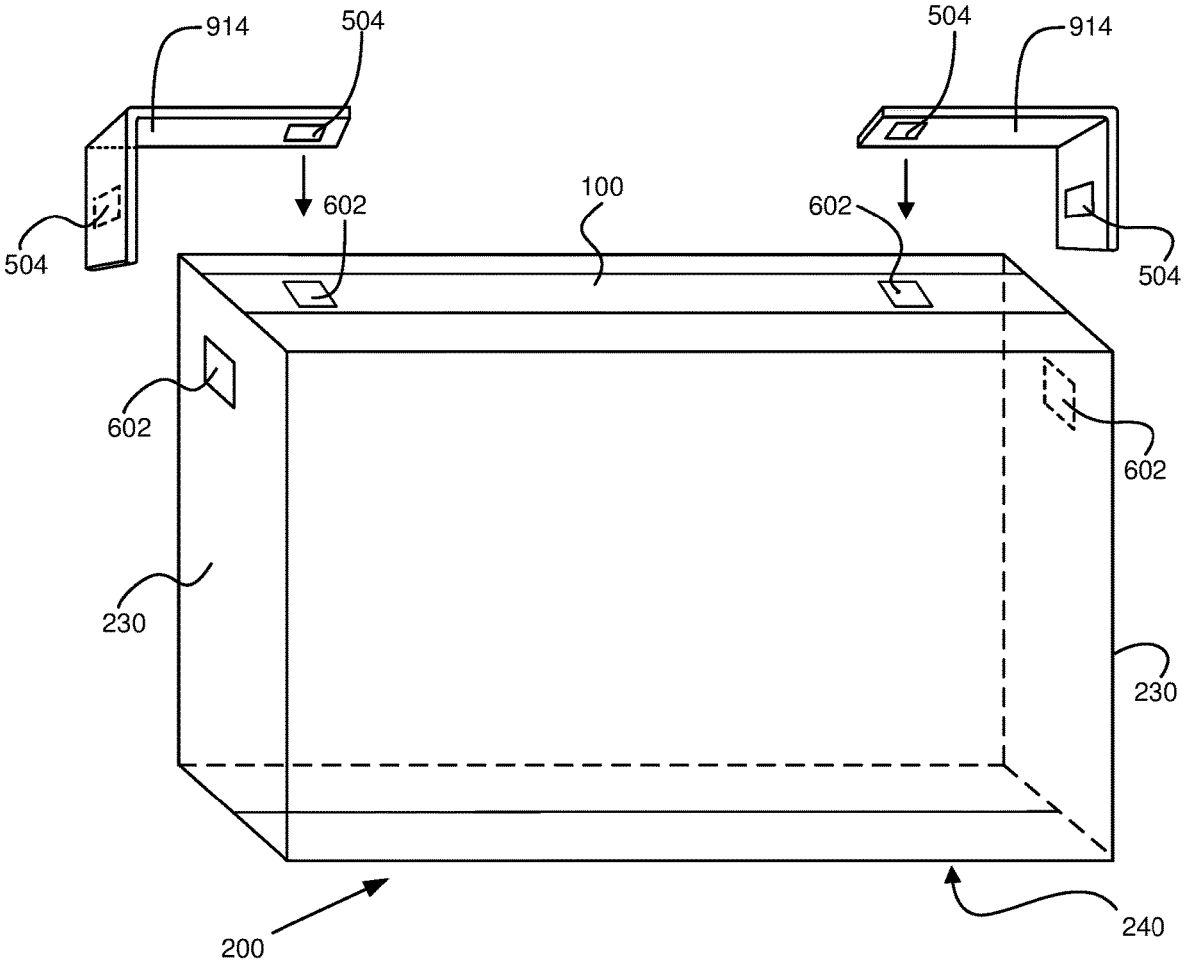
FIG. 12B is a perspective view of the two straps of FIG. 12A being coupled to a connection mechanism and the sides of a container, according to various embodiments.

FIG. 12A is a view of two straps 914 for maintaining a container 200 in a closed position, according to various embodiments. FIG. 12B is a perspective view of the two straps 914 of FIG. 12A being coupled to a connection mechanism 100 and to the sides 230 of a container 200, according to various embodiments. In some embodiments the two straps 914 are configured to be detachably couplable to the connection mechanism 100 and one of the opposite sides 230 of the container 200. In some embodiments the coupling mechanisms 504 are fixed to the two straps 500 and complementary coupling mechanisms 602 are fixed to the opposite sides 230 of the container 200 and are positioned so when the coupling mechanisms 504 and the complementary coupling mechanisms 602 are detachably coupled, the straps 914 are flush with the sides 230 of the container 200.

While the connection mechanism 900 of FIGS. 9A-9D are depicted connected to top flaps 201, 205 of a container 200, embodiments described herein are applicable to a connection mechanism 900 being connected to bottom flaps 241, 245 of the container 200. In some embodiments, the container 200 includes two connection mechanisms 900 where one is on top and one is on the bottom. In various embodiments, the connection mechanisms 100, 900 described herein, the strap 500 and/or hook and loop fastener 1000 described herein may be applied to a top or a bottom not including a connection mechanism 100, 200. One of skill in the art will recognize other ways to mix and match connection mechanisms 100, 200, straps 500, and/or hook and loop fasteners 1000.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a connection mechanism couplable to a container, the container comprising a bottom, a top, and sides, the top comprising a first flap and a second flap, the first flap comprising a first hinge end and a first edge opposite the first hinge end, the second flap comprising a second hinge end and a second edge opposite the second hinge end, the first and second hinge ends are each connected to a side of the container, the connection mechanism extending substantially along an entire length of the first edge of the first flap, wherein the length of the first edge extends from a first side to an opposite second side of the sides of the container, wherein the first edge is adjacent to the second edge of the second flap when the first and second flaps are in a closed position, and wherein the connection mechanism comprises:

a tab couplable along the first edge of the first flap; and a channel opposite the tab configured to enclose a portion of the second flap along a substantial portion of the second edge, wherein the channel comprises an upper wall and a lower wall forming a channel therebetween, the channel sized to accommodate a thickness of second flap, the thickness measured in a direction orthogonal to a length between the first and second edges of the second flap and orthogonal to a length of the first edge, wherein when the first and second flaps are in an open position the tab remains coupled to the first flap, and wherein when the first and second flaps are in the closed position the channel maintains the second edge in the channel while the tab remains coupled to the first flap.

2. The apparatus of claim 1, wherein the tab of the connection mechanism is fixedly coupled to the first flap.

3. The apparatus of claim 2, wherein the tab is fixedly coupled to the first flap by:

an adhesive strip;

a mechanical fastener, wherein the mechanical fastener is a staple, clamp, and/or brad fastener;

a hook and loop mechanism; and/or an adhesive.

4. The apparatus of claim 1, wherein the channel comprises an upper wall and a lower wall forming a channel there between, the upper wall extending away from the tab a longer distance than the lower wall.

5. The apparatus of claim 1, wherein the lower wall comprising a tapered edge such that the channel is wider at an opening of the channel than interior portions of the channel beyond the tapered edge.

6. The apparatus of claim 1, wherein the channel is a first channel and the tab is a first tab and further comprising a second tab, the first tab and the second tab forming a second channel therebetween, the second channel configured to couple to the first flap by a friction fit.

7. The apparatus of claim 1, wherein the connection mechanism comprises a rigid material.

8. The apparatus of claim 1, wherein the channel maintains the second flap within the channel when the first flap and the second flap are in the closed position, a depth of the channel is configured to allow the second flap to enter the channel without creasing the second flap.

9. The apparatus of claim 1, further comprising a strap, detachably coupled to opposite sides of the container, such that the strap maintains one of the bottom in a closed position or the first and second flaps in the closed position, the bottom comprising a third flap and a fourth flap, the third flap comprising a third hinge end and an third edge opposite the third hinge end, the fourth flap comprising a fourth hinge end and a fourth edge opposite the fourth hinge end, the third and fourth hinge ends are each connected to a side of the container.

10. The apparatus of claim 1, further comprising one or more straps extending from sides of the connection mechanism to at least one of opposite sides of the container, wherein the one or more straps are couplable to one or both sides of the opposite sides of the container.

11. The apparatus of claim 10, wherein the strap is configured to be detachably couplable to the connection mechanism and the opposite sides of the container such that the strap maintains the top of the container in the closed position.

12. The apparatus of claim 10, wherein the strap is a first strap and extends from a first side of the connection mechanism and further comprising a second strap extending from a second side of the connection mechanism, wherein each of the first and second straps is configured to be detachably couplable to the connection mechanism and/or one of opposite sides of the container.

13. The apparatus of claim 1, further comprising two or more hook and loop fasteners, each hook and loop fastener comprising a first portion couplable to a second portion, wherein the first portion comprises tapered edges on each end and the second portion has ends configured to connect with corresponding tapered edges of the first portion that are wider than the tapered edges of the first portion, wherein the two or more hook and loop fasteners are positioned between the flaps of the top of the container and/or between flaps of the bottom of the container to hold the flaps of the top and/or the flaps of the bottom together.

14. An apparatus comprising:

a connection mechanism couplable to a container, the container comprising a bottom, a top, and sides, the top comprising a first flap and a second flap, the first flap comprising a first hinge end and a first edge opposite the first hinge end, the second flap comprising a second hinge end and a second edge opposite the second hinge end, the first and second hinge ends are each connected to a side of the container, the connection mechanism extending substantially along an entire length of the first edge of the first flap, wherein the length of the first edge extends from a first side to an opposite second side of the sides of the container, wherein the first edge is adjacent to the second edge of the second flap when the first and second flaps are in a closed position, and wherein the connection mechanism comprises:

a tab couplable along the first edge of the first flap;

a channel opposite the tab configured to enclose a portion of the second flap along a substantial portion of the second edge, wherein the channel comprises an upper wall and a lower wall forming a channel therebetween, the channel sized to accommodate a thickness of second flap, the thickness measured in a direction orthogonal to a length between the first and second edges of the second flap and orthogonal to a length of the first edge, wherein when the first and second flaps are in an open position the tab remains coupled to the first flap, and wherein when the first and second flaps are in the closed position the channel maintains the second edge in the channel while the tab remains coupled to the first flap; and one or more straps extending from sides of the connection mechanism to at least one of opposite sides of the container, wherein the one or more straps are couplable to one or both of the opposite sides of the container.

15. The apparatus of claim 14, wherein the one or more straps are fixed to the connection mechanism.

16. The apparatus of claim 14, wherein the one or more straps are removably coupled to the connection mechanism.

17. The apparatus of claim 14, wherein one of:

the one or more straps comprises a single strap coupled to the connection mechanism, wherein a length of the single strap exceeds a length of the connection mechanism and the single strap is configured to be couplable to both of the opposite sides of the container; or the one or more straps comprises two straps, wherein each of the two straps is couplable to the connection mechanism and to one of the opposite sides of the container.

18. The apparatus of claim 14, wherein the one or more straps comprise a pliable material.

19. The apparatus of claim 14, further comprising two or more hook and loop fasteners, each hook and loop fastener comprising a first portion couplable to a second portion, wherein the first portion comprises tapered edges on each end and the second portion has ends configured to connect with corresponding tapered edges of the first portion that are wider than the tapered edges of the first portion, wherein the two or more hook and loop fasteners are positioned between flaps of the top of the container and/or between flaps of the bottom of the container to hold the flaps of the top and/or the flaps of the bottom together.

20. An apparatus comprising:

a connection mechanism, couplable to a container top, the container top comprising a first flap and a second flap, the first flap comprising a first hinge end and a first edge opposite the first hinge end, the second flap comprising a second hinge end and a second edge opposite the second hinge end, the first and second hinge ends are each connected to a side of the container, the connection mechanism extending substantially along the first edge of the first flap, wherein the first edge is adjacent to the second edge of the second flap when the first and second flaps are in a closed position, and wherein the connection mechanism comprises:

a tab couplable along the first edge of the first flap;

a channel opposite the tab configured to enclose a portion of the second flap along a substantial portion of the second edge, wherein when the first and second flaps are in an open position the tab remains coupled to the first flap, and wherein when the first and second flaps are in the closed position the channel maintains the second edge in the channel while the tab remains coupled to the first flap; and one or more straps extending from sides of the connection mechanism to at least one of opposite sides of the container, wherein the one or more straps are couplable to one or both of the opposite sides of the container;

one or more of:

a strap, detachably couplable to opposite sides of the container, such that the strap maintains a container bottom of the container in a closed position, the bottom comprising a third flap and a fourth flap, the third flap comprising a third hinge end and a third edge opposite the third hinge end, the fourth flap comprising a fourth hinge end and a fourth edge opposite the fourth hinge end, the third and fourth hinge ends are each connected to a side of the container; and two or more hook and loop fasteners, each hook and loop fastener comprising a first portion couplable to a second portion, wherein the first portion comprises tapered edges on each end and the second portion has ends configured to connect with corresponding tapered edges of the first portion that are wider than the tapered edges of the first portion, wherein the two or more hook and loop fasteners are positioned between the third and fourth flaps of the container bottom and corresponding flaps interior to the container on the container bottom and maintain the third and fourth flaps in the closed position.

* * * * *